US009895890B2

(12) United States Patent
Koga et al.

(10) Patent No.: US 9,895,890 B2
(45) Date of Patent: Feb. 20, 2018

(54) INK JET RECORDING APPARATUS

(71) Applicant: FUJIFILM Corporation, Tokyo (JP)

(72) Inventors: Takehiko Koga, Ashigarakami-gun (JP); Tsutomu Kusakari, Ashigarakami-gun (JP)

(73) Assignee: FUJIFILM Corporation, Minato-ku, Tokyo (JP)

( * ) Notice: Subject to any disclaimer, the term of this patent is extended or adjusted under 35 U.S.C. 154(b) by 0 days.

(21) Appl. No.: 15/681,579

(22) Filed: Aug. 21, 2017

(65) Prior Publication Data

US 2017/0368827 A1 Dec. 28, 2017

Related U.S. Application Data

(63) Continuation of application No. PCT/JP2015/083945, filed on Dec. 3, 2015.

(30) Foreign Application Priority Data

Mar. 11, 2015 (JP) ..... 2015-048253

(51) Int. Cl.
*B41J 2/155* (2006.01)
*B41J 2/175* (2006.01)
*B41J 25/00* (2006.01)

(52) U.S. Cl.
CPC ..... *B41J 2/155* (2013.01); *B41J 2/1752* (2013.01); *B41J 2025/008* (2013.01);
(Continued)

(58) Field of Classification Search
CPC .... B41J 2/155; B41J 2025/008; B41J 2/1752; B41J 2202/14
See application file for complete search history.

(56) References Cited

U.S. PATENT DOCUMENTS 5,343,227 A * 8/1994 Hirosawa ..... B41J 2/155 346/139 R
6,505,908 B1 * 1/2003 Akahira ..... B41J 2/04 347/18

(Continued)

FOREIGN PATENT DOCUMENTS

JP 03-227634 A 10/1991
JP 2009-279783 A 12/2009

(Continued)

OTHER PUBLICATIONS

International Preliminary Report on Patentability dated Sep. 12, 2017, in counterpart International Application No. PCT/JP2015/083945.

(Continued)

*Primary Examiner* — Julian Huffman
(74) *Attorney, Agent, or Firm* — Sughrue Mion, PLLC

(57) ABSTRACT

There is provided an ink jet recording apparatus that can correct bending of an ink jet head with a compact structure. First supporting frames 122 that support ink jet heads 110C, 110M, 110Y, and 110K and second supporting frames 170 that support a part of ink supply sections supplying ink to the ink jet heads 110C, 110M, 110Y, and 110K are mounted on a mount 300. The first supporting frames 122 are mounted on the mount 300 while both end portions of the first supporting frames 122 in a longitudinal direction are supported. Each of the second supporting frames 170 is provided with a bending correction mechanism 340 that applies a pressing force to the first supporting frame 122 to correct the bending of the first supporting frame 122.

20 Claims, 18 Drawing Sheets

(52) U.S. Cl.
CPC ..... *B41J 2202/14* (2013.01); *B41J 2202/20* (2013.01); *B41J 2202/21* (2013.01)

(56) References Cited

U.S. PATENT DOCUMENTS

| | | | | |
|---|---|---|---|---|
| 7,618,118 | B2 * | 11/2009 | Taira | B41J 2/14209 347/17 |
| 8,851,660 | B2 * | 10/2014 | Furukawa | B41J 2/16 347/100 |
| 2005/0206714 | A1 * | 9/2005 | Greiser | B41J 2/1752 347/108 |

FOREIGN PATENT DOCUMENTS

| | | | | |
|---|---|---|---|---|
| JP | 2012-071472 | A | 4/2012 | |
| JP | 2013-230643 | A | 11/2013 | |
| WO | WO 2017073526 | A1 * | 5/2017 | B41J 2/01 |

OTHER PUBLICATIONS

Translation of Written Opinion of the International Searching Authority dated Jan. 26, 2016, in counterpart International Application No. PCT/JP2015/083945 (original document submitted on Aug. 21, 2017).
International Search Report of PCT/JP2015/083945 dated Jan. 26, 2016 [PCT/ISA/210].
Written Opinion of PCT/JP2015/083945 dated Jan. 26, 2016 [PCT/ISA/237].

* cited by examiner

INK JET RECORDING APPARATUS

CROSS-REFERENCE TO RELATED APPLICATIONS

This application is a Continuation of PCT International Application No. PCT/JP2015/083945 filed on Dec. 3, 2015, which claims priority under 35 U.S.C. § 119(a) to Japanese Patent Application No. 2015-048253 filed on Mar. 11, 2015. Each of the above application(s) is hereby expressly incorporated by reference, in its entirety, into the present application.

BACKGROUND OF THE INVENTION

1. Field of the Invention

The present invention relates to an ink jet recording apparatus, and more particularly, to a line-type ink jet recording apparatus on which long ink jet heads of which length in a nozzle arrangement direction is longer than length in a direction orthogonal to the nozzle arrangement direction are mounted.

2. Description of the Related Art

Ink jet heads, which have a length corresponding to the width of a medium as a recording target, are mounted on a line-type ink jet recording apparatus that can record a desired image on a medium by single pass. Accordingly, as the width of a medium as a recording target increases, longer ink jet heads are mounted on the line-type ink jet recording apparatus.

Generally, an ink jet head of which the length in the longitudinal direction is long is installed at a predetermined position in the apparatus while both end portions of the ink jet head in the longitudinal direction are supported.

However, in a case in which the ink jet head is supported in this way, the ink jet head is bent by its own weight and warpage occurs. For this reason, since a deviation in ink landing positions is generated due to this warpage, there is a problem that the quality of an image deteriorates.

Accordingly, JP1991-227634A (JP-H03-227634A) proposes a method of correcting bending, which includes a step of providing warpage correction means on a mount on which an ink jet head is installed and a step of applying a force to the ink jet head in a direction in which warpage is cancelled by the warpage correction means.

SUMMARY OF THE INVENTION

However, in a structure in which the warpage correction means is provided on the mount as in JP1991-227634A (JP-H03-227634A), the warpage correction means for each of the ink jet heads should be installed on the mount in a case in which a plurality of ink jet heads are installed on the mount. For this reason, there is a drawback that a part on which the ink jet heads are to be installed increases in size.

The invention has been made in consideration of the above-mentioned circumstances, and an object of the invention is to provide an ink jet recording apparatus that can correct bending of an ink jet head with a compact structure.

(1) An ink jet recording apparatus comprising: a plurality of recording units each of which comprises a long ink jet head and an ink supply section supplying ink to the ink jet head; a plurality of supporting frames each of which comprises a first supporting frame supporting the ink jet head and a second supporting frame supporting at least a part of the ink supply section; a mount that comprises a plurality of first supporting frame supports supporting both ends of the first supporting frames in a longitudinal direction and a plurality of second supporting frame supports supporting the second supporting frames; and bending correction unit that are provided on the second supporting frames and apply pressing forces or tensile forces to at least a part of the first supporting frames to correct bending of the first supporting frames in a case in which the first supporting frames are supported by the first supporting frame supports.

According to this aspect, the supporting frame is provided for each of the recording units. The supporting frame includes the first supporting frame that supports the ink jet head and the second supporting frame that supports at least a part of the ink supply section. The first supporting frames are mounted on the mount while both ends of each first supporting frame in the longitudinal direction are supported by the first supporting frame supports provided on the mount. The second supporting frames are mounted on the mount while being supported by the second supporting frame supports provided on the mount. Each of the second supporting frames is provided with the bending correction unit. The bending correction unit apply pressing forces or tensile forces to at least a part of the first supporting frames to correct the bending of the first supporting frames. Since the bending correction unit is provided on the second supporting frame, a part on which the ink jet heads are to be installed can be made compact relative to the mount. Further, since the ink jet head is supported independently of the ink supply section, the support of the ink jet head can be reduced in weight. Accordingly, the bending of the ink jet head caused by its own weight can be suppressed.

(2) The ink jet recording apparatus according to (1), wherein the ink jet head includes a plurality of joined head modules.

According to this aspect, the ink jet head includes a plurality of joined head modules. Since the plurality of head modules are joined to form one ink jet head, an ink jet head, which is long in the longitudinal direction, can be easily manufactured.

(3) The ink jet recording apparatus according to (1) or (2), wherein the first supporting frame supports are arranged in the shape of an arc along an arc-shaped transport path of a medium that is transported along the transport path.

According to this aspect, the first supporting frame supports are arranged in the shape of an arc along an arc-shaped transport path of a medium that is transported along the transport path. This transport path is formed, for example, in a case in which a medium is transported while being wound around the peripheral surface of the rotating drum. Further, in a case in which the first supporting frame supports are arranged in the shape of an arc along the arc-shaped transport path, the ink jet heads are obliquely installed at different angles.

(4) The ink jet recording apparatus according to any one of (1) to (3), wherein the first and second supporting frames of the supporting frame are connected to each other by a connecting member.

According to this aspect, the first and second supporting frames are connected to each other by the connecting member. Accordingly, when being attached to or detached from the mount, the first and second supporting frames can be integrally attached to or detached from the mount.

(5) The ink jet recording apparatus according to any one of (1) to (4), wherein the bending correction unit comprise springs, and apply pressing forces or tensile forces, which are generated by the springs, to the first supporting frames.

According to this aspect, the bending correction unit comprise springs, and pressing forces or tensile forces, which are generated by the springs, are applied to the first supporting frames.

(6) The ink jet recording apparatus according to (5), wherein the bending correction unit further comprise levers, and apply pressing forces or tensile forces, which are generated by the springs, to the first supporting frames through the levers.

According to this aspect, pressing forces or tensile forces, which are generated by the springs, are applied to the first supporting frames through the levers. Accordingly, large pressing forces or large tensile forces can be applied to the first supporting frames by small forces of the springs.

(7) The ink jet recording apparatus according to any one of (1) to (4), wherein the bending correction unit comprise first springs each of which pulls one end of the first supporting frame in a lateral direction and second springs each of which pulls the other end of the first supporting frame in the lateral direction.

According to this aspect, the bending correction unit comprise the first springs and the second springs. The first spring pulls one end of the first supporting frame in the lateral direction, and the second spring pulls the other end of the first supporting frame in the lateral direction. Since it is possible to easily control a force to be applied to the first supporting frame by adjusting the tensile force that is generated by the first spring and the tensile force that is generated by the second spring, bending can be appropriately corrected. Particularly, bending can be appropriately corrected in a case in which the ink jet heads are obliquely installed.

(8) The ink jet recording apparatus according to any one of (1) to (6), wherein the bending correction unit apply tensile forces to the first supporting frames of the supporting frames that are adjacently disposed.

According to this aspect, the bending correction unit, which is provided on the second supporting frame of each supporting frame, applies a tensile force to the first supporting frame of the supporting frame that is adjacently disposed. Accordingly, it is possible to appropriately apply a tensile force to the first supporting frame by effectively using a space between the respective supporting frames.

(9) The ink jet recording apparatus according to any one of (1) to (8), wherein the first and second supporting frames of the supporting frames are arranged in series in an ink jetting direction of the ink jet head supported by the first supporting frame.

According to this aspect, the first and second supporting frames are arranged in series in an ink jetting direction of the ink jet head supported by the first supporting frame. For example, in a case in which ink is jetted vertically downward from the ink jet head supported by the first supporting frame, the second supporting frame is disposed immediately above the first supporting frame. Accordingly, since an interval between the adjacent supporting frames can be made short, a part on which the ink jet heads are to be installed can be made compact.

(10) The ink jet recording apparatus according to any one of (1) to (9), further comprising:

a carriage on which the mount is mounted.

According to this aspect, the mount is mounted on the carriage. Accordingly, the plurality of ink jet heads mounted on the mount can be moved integrally.

According to the invention, it is possible to correct the bending of an ink jet head with a compact structure.

DESCRIPTION OF THE PREFERRED EMBODIMENTS

Embodiments of the invention will be described in detail below with reference to the accompanying drawings.

<<Entire Structure of Ink Jet Recording Apparatus>>

Figure 1:
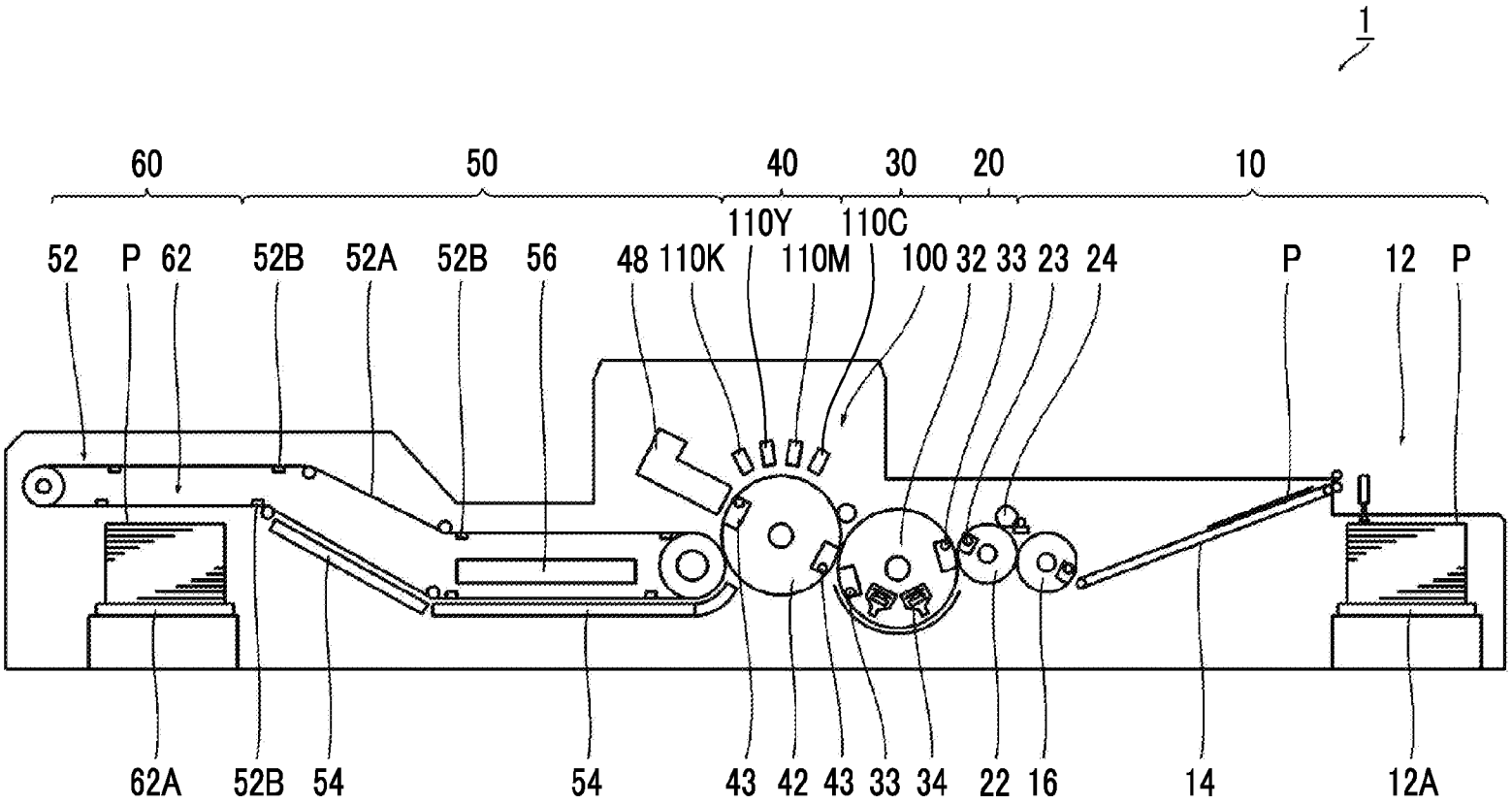
FIG. 1 is a front view showing the schematic structure of an ink jet recording apparatus.

FIG. 1 is a front view showing the schematic structure of an ink jet recording apparatus. Further, FIG. 2 is a plan view of the ink jet recording apparatus shown in FIG. 1.

An ink jet recording apparatus 1 of this embodiment is a line-type ink jet recording apparatus that records a color image on a sheet of paper by a single-pass method with line-type ink jet heads. Particularly, the ink jet recording apparatus 1 of this embodiment is an ink jet recording apparatus that records an image on a general-purpose printing sheet with aqueous ink. Here, aqueous ink means ink in which a color material, such as dye or a pigment, is dissolved or dispersed in water and a solvent soluble in water. Further, a general-purpose printing sheet means not a so-called exclusive sheet for ink jet but a sheet using cellulose as a main component, such as coated paper, which is generally used for offset printing and the like.

Figure 2:
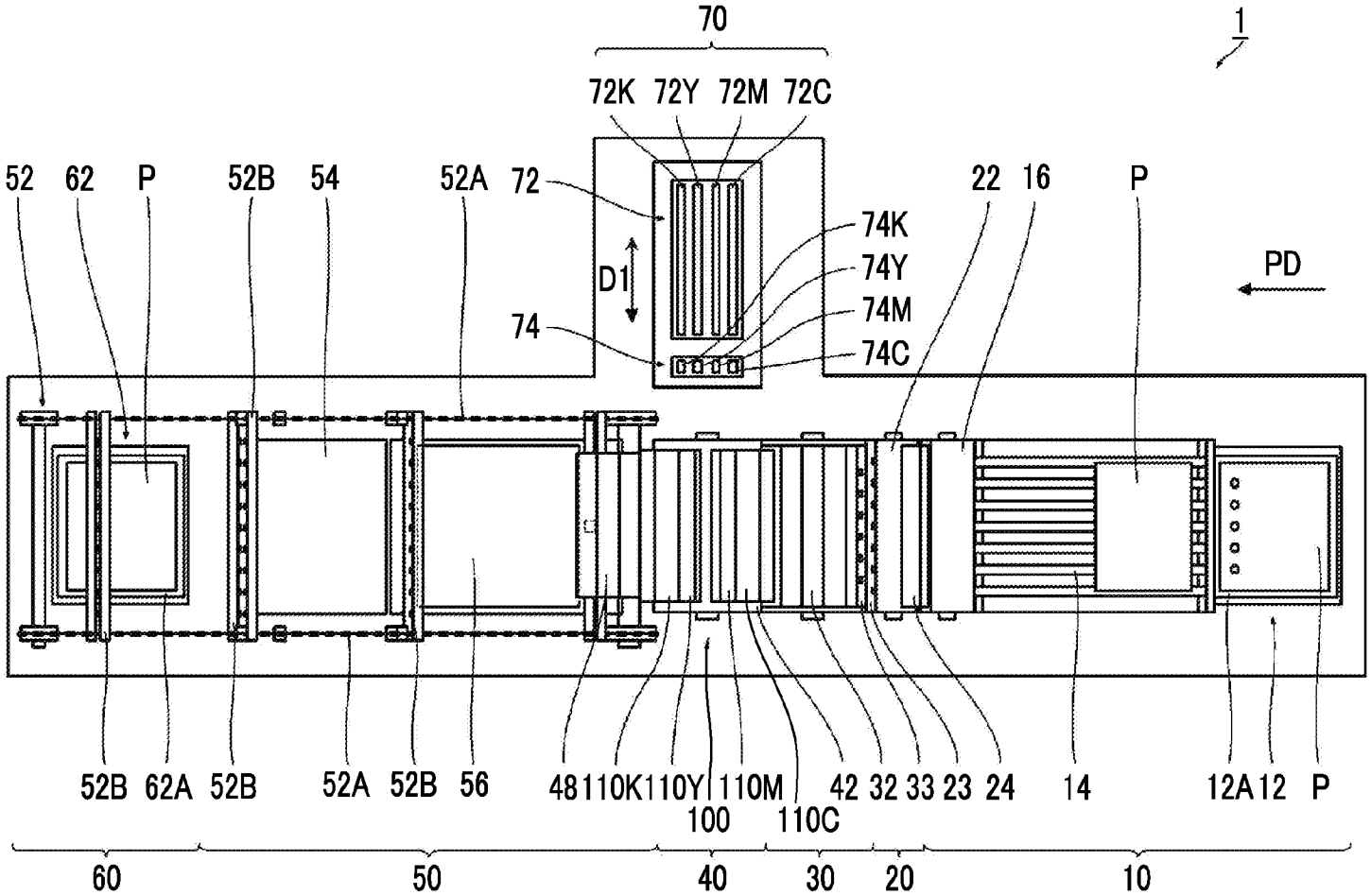
FIG. 2 is a plan view of the ink jet recording apparatus shown in FIG. 1.

As shown in FIGS. 1 and 2, the ink jet recording apparatus 1 of this embodiment mainly includes: a sheet feeding section 10 that feeds a sheet P; a treatment liquid applying section 20 that applies treatment liquid to the sheet P fed from the sheet feeding section 10; a treatment liquid drying section 30 that performs processing for drying the sheet P to which the treatment liquid has been applied; an image recording section 40 that records a color image on the sheet P, which has been subjected to drying processing, by an ink jet method; an ink drying section 50 that performs processing for drying the sheet P on which the image has been recorded; a collection section 60 that collects the sheet P having been subjected to drying processing; and a maintenance section 70 that performs the maintenance of the ink jet heads of the image recording section 40.

<Sheet Feeding Section>

The sheet feeding section 10 automatically feeds sheets P one by one. As shown in FIGS. 1 and 2, the sheet feeding section 10 mainly includes a sheet feeding device 12, a feeder board 14, and a sheet feed drum 16.

The sheet feeding device 12 sequentially takes out the sheets P, which are set on a sheet feed tray 12A in the form of a bundle, from the top of the bundle one by one and feeds the sheets P to the feeder board 14.

The feeder board 14 receives the sheets P that are fed from the sheet feeding device 12 and transfers the received sheets P to the sheet feed drum 16.

The sheet feed drum 16 receives the sheets P fed from the feeder board 14 and transfers the received sheets P to the treatment liquid applying section 20.

<Treatment Liquid Applying Section>

The treatment liquid applying section 20 applies treatment liquid to the sheet P. The treatment liquid is liquid having a function to allow a color material component, which is contained in ink, to aggregate, to insolubilize the color material component, or to thicken the color material component. Since the treatment liquid is applied to the sheet P, a high-quality image can be recorded even in a case in which a general-purpose printing sheet is used.

As shown in FIGS. 1 and 2, the treatment liquid applying section 20 mainly includes a treatment liquid applying drum 22 that transports a sheet P, and a treatment liquid applying device 24 that applies treatment liquid to the sheet P transported by the treatment liquid applying drum 22.

The treatment liquid applying drum 22 receives the sheet P from the sheet feed drum 16 of the sheet feeding section 10, and transfers the received sheet P to the treatment liquid drying section 30. The treatment liquid applying drum 22 includes a gripper 23 provided on the peripheral surface thereof, and transports the sheet P while winding the sheet P around the peripheral surface thereof by gripping a front end of the sheet P by the gripper 23 and rotating. Here, the front end of the sheet P means the front end portion of the sheet P in a transport direction.

The treatment liquid applying device 24 applies treatment liquid to the sheet P that is transported by the treatment liquid applying drum 22. The treatment liquid applying device 24 includes an application roller, and applies the treatment liquid to the recording surface of the sheet P while making the application roller be in contact with the recording surface of the sheet P. Here, the recording surface of the sheet P means the surface of the sheet P on which an image is to be recorded.

The treatment liquid applying section 20 has the above-mentioned structure. While a sheet P is transported by the treatment liquid applying drum 22, treatment liquid is applied to the recording surface.

<Treatment Liquid Drying Section>

The treatment liquid drying section 30 performs processing for drying the sheets P to which treatment liquid has been applied. The treatment liquid drying section 30 mainly includes a treatment liquid drying drum 32 that transports sheets P, and a plurality of hot air blowers 34 that blow hot air to the recording surfaces of the sheets P transported by the treatment liquid drying drum 32.

The treatment liquid drying drum 32 receives the sheet P from the treatment liquid applying drum 22 of the treatment liquid applying section 20, and transfers the received sheet P to the image recording section 40. The treatment liquid drying drum 32 is formed of a frame body formed in a cylindrical shape, and includes grippers 33 provided on the peripheral surface thereof. The treatment liquid drying drum 32 transports sheets P by gripping the front ends of the sheets P by the grippers 33 and rotating.

The hot air blowers 34 are installed in the treatment liquid drying drum 32. The hot air blowers 34 blow hot air to the sheets P transported by the treatment liquid drying drum 32. Hot air, which is blown from the hot air blowers 34, is blown to the recording surfaces of the sheets P. Accordingly, treatment liquid is dried.

The treatment liquid drying section 30 has the above-mentioned structure. While sheets P are transported by the treatment liquid drying drum 32, hot air is blown to the recording surfaces of the sheets and the sheets P are subjected to drying processing.

<Image Recording Section>

The image recording section 40 records a color image on the sheet P with inks having four colors of cyan (C), magenta (M), yellow (Y), and black (K). As shown in FIG. 1, the image recording section 40 mainly includes an image recording drum 42 that transports sheets P, a head unit 100, and a scanner 48 that reads an image recorded on the sheet P.

The image recording drum 42 receives the sheets P from the treatment liquid drying drum 32 of the treatment liquid drying section 30, and transfers the received sheets P to the ink drying section 50. The image recording drum 42 includes grippers 43 provided on the peripheral surface thereof, and transports the sheets P while winding the sheets P around the peripheral surface thereof by gripping the front ends of the sheets P by the grippers 43 and rotating. Further, the image recording drum 42 includes a suction mechanism (not shown) and transports the sheets P while making the sheets P be sucked on the peripheral surface thereof. Negative pressure is used to make the sheets P be sucked. The peripheral surface of the image recording drum 42 is provided with a plurality of suction holes. The suction mechanism makes the sheets P be sucked on the peripheral surface of the image recording drum 42 by sucking air from the inside of the image recording drum 42 through the suction holes.

The head unit 100 includes an ink jet head 110C that jets cyan ink droplets, an ink jet head 110M that jets magenta ink droplets, an ink jet head 110Y that jets yellow ink droplets, and an ink jet head 110K that jets black ink droplets. Each of the ink jet heads 110C, 110M, 110Y, and 110K is formed of a line-type ink jet head that can record a desired image on the sheet P, which is transported by the image recording drum 42, by single pass. Further, each of the ink jet heads 110C, 110M, 110Y, and 110K includes a plurality of joined head modules. This will be described in detail below.

The respective ink jet heads 110C, 110M, 110Y, and 110K are arranged at regular intervals along a transport path of the sheet P that is transported by the image recording drum 42.

Figure 3:
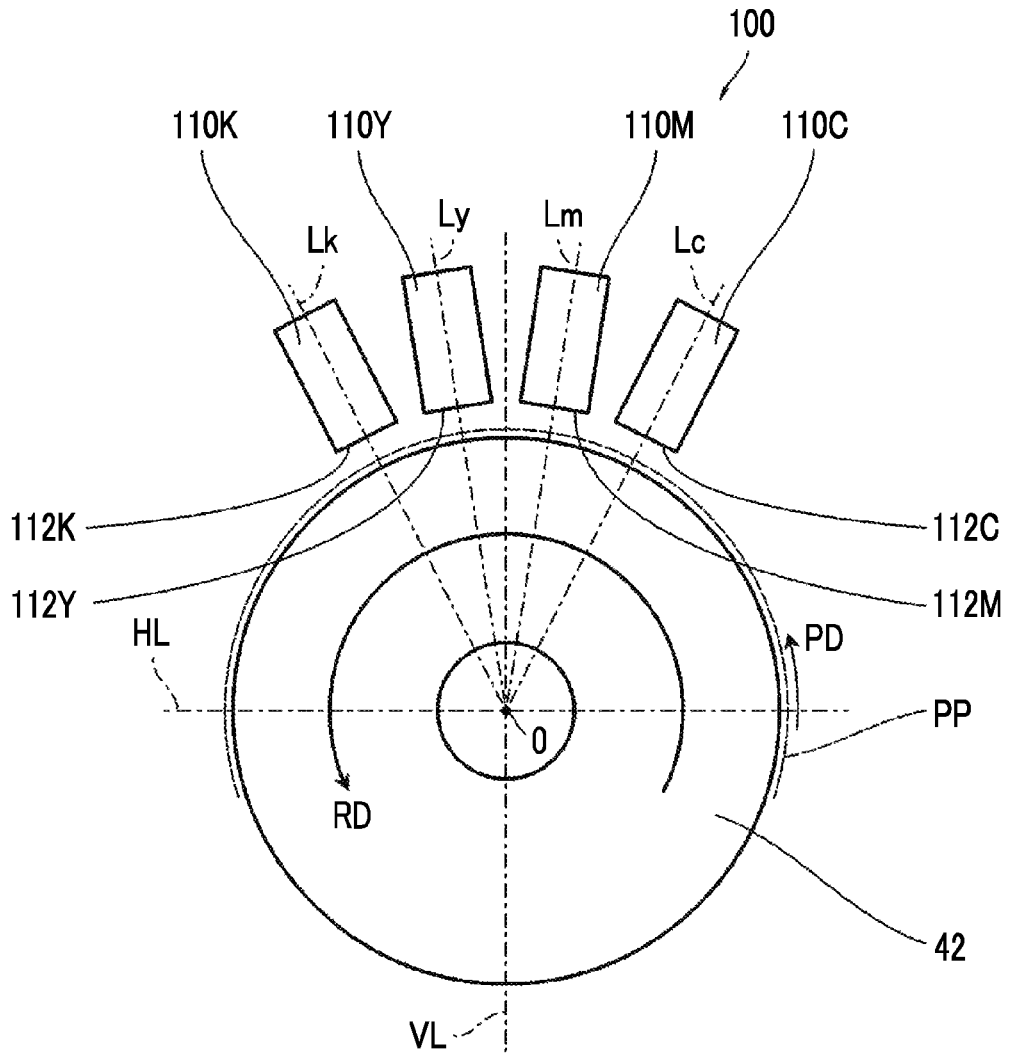
FIG. 3 is a diagram showing the arrangement relationship of ink jet heads with respect to an image recording drum.

FIG. 3 is a diagram showing the arrangement relationship of the ink jet heads with respect to the image recording drum.

In FIG. 3, reference letter O denotes the center of rotation of the image recording drum 42 and reference letter PP denotes the transport path of the sheet P that is transported by the image recording drum 42. Further, reference letter VL denotes a vertical line passing through the center O of rotation of the image recording drum 42, and reference letter HL denotes a horizontal line passing through the center O of rotation of the image recording drum 42. Furthermore, an arrow denoted by reference letter PD represents the transport direction of the sheet P that is transported by the image recording drum 42, and an arrow denoted by reference letter RD represents the rotational direction of the image recording drum 42.

Since the transport path PP of the sheet P, which is transported by the image recording drum 42, is formed in the shape of an arc as shown in FIG. 3, the respective ink jet heads 110C, 110M, 110Y, and 110K are arranged in the shape of an arc at regular intervals along the arc-shaped transport path PP. Particularly, in the ink jet recording apparatus 1 of this embodiment, four ink jet heads 110C, 110M, 110Y, and 110K are arranged in the shape of an arc so as to be symmetrical with respect to the vertical line VL passing through the center O of rotation of the image recording drum 42.

The ink jet heads 110C, 110M, 110Y, and 110K include nozzle surfaces 112C, 112M, 112Y, and 112K at the tips thereof, respectively; and vertically jet ink droplets to the sheet P, which is transported by the image recording drum 42, from nozzles provided on the nozzle surfaces 112C, 112M, 112Y, and 112K.

Here, in a case in which straight lines, which pass through the centers of the nozzle surfaces 112C, 112M, 112Y, and 112K of the ink jet heads 110C, 110M, 110Y, and 110K and are perpendicular to the nozzle surfaces 112C, 112M, 112Y, and 112K, are denoted by Lc, Lm, Ly, and Lk, respectively, the respective ink jet heads 110C, 110M, 110Y, and 110K are arranged so that the straight lines Lc, Lm, Ly, and Lk perpendicular to the nozzle surfaces 112C, 112M, 112Y, and 112K pass through the center O of rotation of the image recording drum 42 and are arranged at regular angular intervals.

Further, the respective ink jet heads 110C, 110M, 110Y, and 110K are arranged so that the nozzle surfaces 112C, 112M, 112Y, and 112K are positioned at positions having a constant height from the peripheral surface of the image recording drum 42.

The ink jet heads 110C, 110M, 110Y, and 110K, which are arranged in this way, are arranged so that the nozzle surfaces 112C, 112M, 112Y, and 112K are inclined with respect to a horizontal plane at different angles.

The respective ink jet heads 110C, 110M, 110Y, and 110K are mounted on a mount (not shown) and form one head unit 100. The mount is mounted on a carriage that moves between the image recording section 40 and the maintenance section 70.

A structure for supporting the ink jet heads 110C, 110M, 110Y, and 110K by the mount will be described in detail below.

The scanner 48 reads the image that is recorded on the sheet P by the ink jet heads 110C, 110M, 110Y, and 110K.

The image recording section 40 has the above-mentioned structure. While the sheet P is transported by the image recording drum 42, ink droplets having the respective colors of cyan, magenta, yellow, and black are jetted to the recording surface from the ink jet heads 110C, 110M, 110Y, and 110K of the head unit 100 and a color image is recorded on the recording surface. The image recorded on the sheet P is read by the scanner 48 as necessary.

<Ink Drying Section>

The ink drying section 50 performs processing for drying the sheet P on which the image has been recorded by the image recording section 40. The ink drying section 50 is an example of a sheet drying device that is assembled to the ink jet recording apparatus.

As shown in FIGS. 1 and 2, the ink drying section 50 mainly includes a chain delivery 52 that transports sheets P, sheet guides 54 that guide the transport of the sheets P, and a hot air blowing unit 56 that blows hot air to the sheets P transported by the chain delivery 52.

The chain delivery 52 receives the sheets P from the image recording drum 42 of the image recording section 40, and transfers the received sheets P to the collection section 60. The chain delivery 52 includes a pair of endless chains 52A traveling along a prescribed travel path, grips the front ends of the sheets P by grippers 52B provided on the pair of chains 52A, and transports the sheets P along a prescribed transport path. The grippers 52B are provided on the chains 52A at regular intervals.

The sheet guides 54 guide the sheets P that are transported by the chain delivery 52. The sheet guide 54 has a flat guide surface. The sheet P, which is transported by the chain delivery 52, is transported while sliding on the guide surface.

The hot air blowing unit 56 blows hot air to the recording surface of the sheets P, which is transported by the chain delivery 52, and dries ink. The hot air blowing unit 56 includes a plurality of nozzles arranged along the transport path of the sheet P, and blows hot air to the sheets P, which are transported by the chain delivery 52, from the nozzles.

The ink drying section 50 has the above-mentioned structure. While sheets P are transported by the chain delivery 52, hot air blown from the hot air blowing unit 56 is blown to the recording surfaces of the sheets and the sheets P are subjected to drying processing.

<Collection Section>

The collection section 60 collects sheets P, which are sequentially discharged, in one place. As shown in FIGS. 1 and 2, the collection section 60 includes a collection device 62 that receives and collects sheets P transported from the ink drying section 50 by the chain delivery 52.

The chain delivery 52 releases the sheets P at a predetermined collection position. The collection device 62 includes a collection tray 62A, receives the sheets P released from the chain delivery 52, and collects the sheets P on the collection tray 62A in the form of a bundle.

<Maintenance Section>

The maintenance section 70 performs the maintenance of the ink jet heads 110C, 110M, 110Y, and 110K of the image recording section 40. As shown in FIG. 2, the maintenance section 70 mainly includes: a cap device 72 that covers the nozzle surfaces of the ink jet heads 110C, 110M, 110Y, and 110K with caps; and a cleaning device 74 that wipes and cleans the nozzle surfaces of the ink jet heads 110C, 110M, 110Y, and 110K.

The cap device 72 includes caps 72C, 72M, 72Y, and 72K for the ink jet heads 110C, 110M, 110Y, and 110K, respectively. The caps 72C, 72M, 72Y, and 72K individually cover the nozzle surfaces of the corresponding ink jet heads 110C, 110M, 110Y, and 110K.

Capping is performed after the ink jet heads 110C, 110M, 110Y, and 110K are moved to a predetermined cap position. As described above, the ink jet heads 110C, 110M, 110Y, and 110K are provided so as to be capable of being moved by the carriage.

In FIG. 2, reference letter D1 denotes a direction in which the ink jet heads 110C, 110M, 110Y, and 110K are moved by the carriage. The ink jet heads 110C, 110M, 110Y, and 110K are horizontally moved in parallel with the rotation axis of the image recording drum 42 by the carriage. The ink jet heads 110C, 110M, 110Y, and 110K are provided so as to be capable of being moved between the cap position and a recording position by the movement of the carriage. When being positioned at the recording position, the ink jet heads 110C, 110M, 110Y, and 110K are disposed on the transport path of the sheet P that is transported by the image recording drum 42. Further, when being positioned at the cap position, the ink jet heads 110C, 110M, 110Y, and 110K are disposed at positions where the caps 72C, 72M, 72Y, and 72K are installed.

The cleaning device 74 includes cleaners 74C, 74M, 74Y and 74K that individually clean the nozzle surfaces of the respective ink jet heads 110C, 110M, 110Y, and 110K. Each of the cleaners 74C, 74M, 74Y and 74K includes a wiping member that wipes the nozzle surface. The wiping member is formed of, for example, a blade or a web and is provided to be capable of moving forward and backward with respect to the nozzle surface. The cleaning device 74 is disposed on the movement path of the ink jet heads 110C, 110M, 110Y, and 110K that are moved by the carriage. While each of the ink jet heads 110C, 110M, 110Y, and 110K is moved to the recording position from the cap position, the wiping member is in pressure contact with the nozzle surface and the nozzle surface is wiped.

The maintenance section 70 has the above-mentioned structure. As described above, capping performed by the cap device 72 is performed by the movement of the ink jet heads 110C, 110M, 110Y, and 110K to the cap position. Capping is performed in a case in which the use of the ink jet heads 110C, 110M, 110Y, and 110K stops for a prescribed time or over, such as when a power source is turned off or when the ink jet heads are in a standby state. Further, purging, preliminary jetting, or the like, which is an example of maintenance, is also performed by the cap device 72.

The cleaning of the nozzle surfaces, which is performed by the cleaning device 74, is performed by the movement of the ink jet heads 110C, 110M, 110Y, and 110K to the recording position from the cap position. The respective cleaners 74C, 74M, 74Y and 74K of the cleaning device 74 make the wiping members be in pressure contact with the nozzle surfaces of the ink jet heads 110C, 110M, 110Y, and 110K, which are being moved to the recording position from the cap position, and wipe the nozzle surfaces by the wiping members.

The maintenance is automatically performed at a timing that is set in advance. Further, the maintenance is forcibly performed according to an instruction sent from an operator. A timing at which the maintenance to be automatically performed is performed is prescribed according to the type of maintenance. The timing at which the maintenance to be automatically performed is prescribed by time having passed, the number of printed sheets, or the like from the previous maintenance.

<<Control System of Ink Jet Recording Apparatus>>

Figure 4:
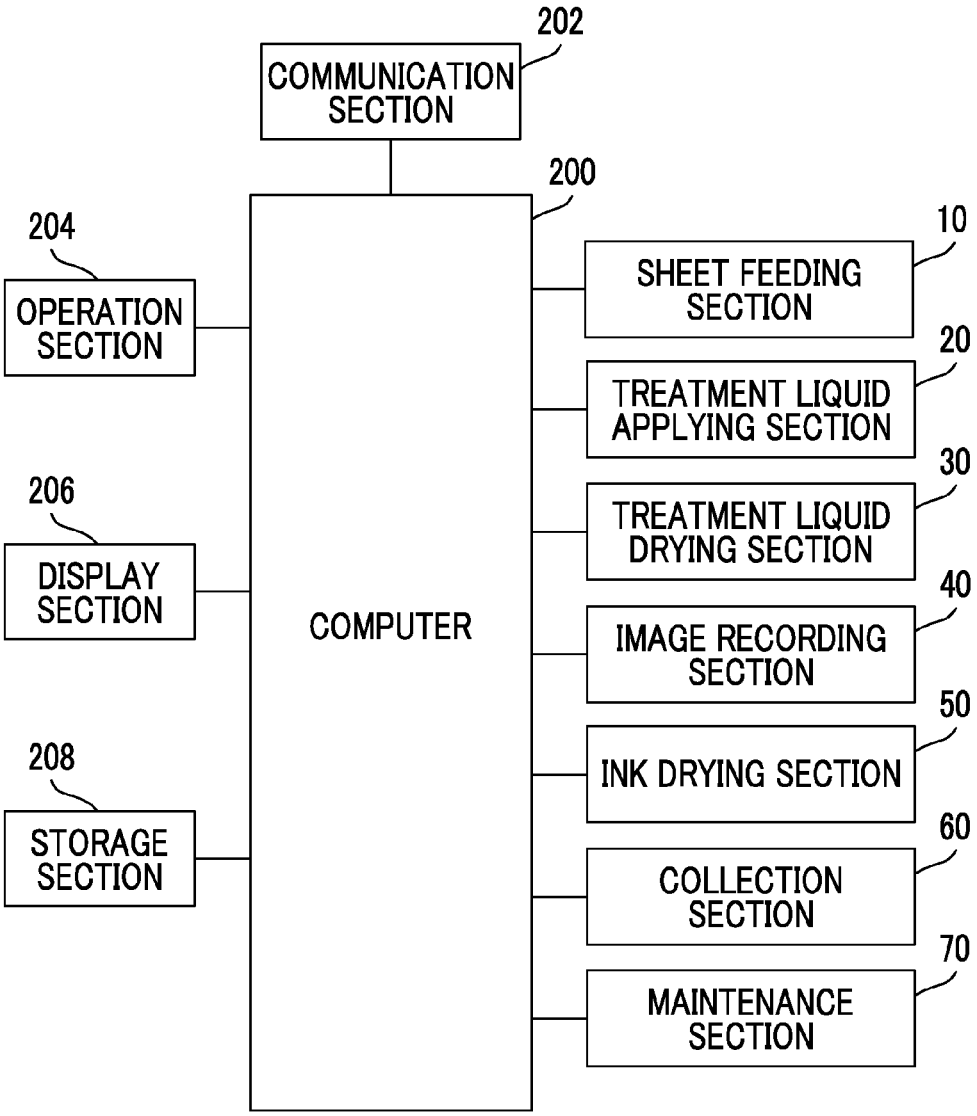
FIG. 4 is a block diagram showing the schematic configuration of a control system of the ink jet recording apparatus.

FIG. 4 is a block diagram showing the schematic configuration of a control system of the ink jet recording apparatus.

As shown in FIG. 4, the ink jet recording apparatus 1 includes a computer 200 as a control section. All operation of the ink jet recording apparatus 1 is controlled by the computer 200. That is, all processings, such as the feeding of a sheet from the sheet feeding section 10, the transport of the fed sheet, the application of treatment liquid in the treatment liquid applying section 20, the drying of the sheet P in the treatment liquid drying section 30, the recording of an image in the image recording section 40, the reading of the recorded image, the drying of the sheet P in the ink drying section 50, the discharge of the sheet P, and the collection of the sheet P in the collection section 60, are performed under the control of the computer 200. Further, the maintenance is also performed under the control of the computer 200.

The computer 200 functions as a control section that controls the respective sections of the ink jet recording apparatus 1 by executing predetermined control programs.

A communication section 202 that is used to communicate with an external device, an operation section 204 that is used to operate the ink jet recording apparatus 1, a display section 206 that is used to display various kinds of information, a storage section 208 that is used to store various data, and the like are connected to the computer 200.

The operation section 204 is formed of, for example, operation buttons or a keyboard, a mouse, a touch panel, or the like. The display section 206 is formed of, for example, a display device, such as a liquid crystal display. The storage section 208 is formed of, for example, a storage device, such as a hard disk drive. The control programs to be executed by the computer 200, various data, and the like are stored in the storage section 208. Further, image data as an object to be recorded is received from an external device, such as a host computer, through the communication section 202.

Furthermore, the computer 200 functions as an image processing section by executing predetermined image processing programs. The image processing section performs processing for converting image data as an object, which is to be recorded, into data formats that can be handled by the ink jet recording apparatus 1. Specifically, the image processing section performs, for example, processing for converting image data, which is represented by a RGB format, into dot arrangement data corresponding to the respective colors of cyan (C), magenta (M), yellow (Y), and black (K). The computer 200 drives the respective ink jet heads 110C, 110M, 110Y, and 110K on the basis of the generated dot arrangement data and records an image on the sheet P.

<<Procedure of Image Recording Processing Performed by Ink Jet Recording Apparatus>>

Next, a procedure of image recording processing, which is performed by the ink jet recording apparatus 1 of this embodiment, will be described.

The recording of an image is performed in the flow of (a) the feeding of a sheet, (b) the application of treatment liquid, (c) the drying of the treatment liquid, (d) recording, (e) the drying of ink, (f) the discharge of the sheet, and (g) collection.

In a case in which the image recording processing is started, sheets P are fed from the sheet feeding section 10 at regular intervals one by one.

First, treatment liquid is applied to the recording surface of the sheet P, which is fed from the sheet feeding section 10, by treatment liquid applying section 20. The treatment liquid applying section 20 applies the treatment liquid to the recording surface of the sheet P, which is transported, a roller.

Then, the sheet P to which the treatment liquid has been applied is subjected to drying processing by the treatment liquid drying section 30. The treatment liquid drying section 30 blows hot air to the recording surface of the sheet P, which is transported, and performs processing for drying the sheet P.

Next, the sheet P, which has been subjected to drying processing, is subjected to recording processing by the image recording section 40. The image recording section 40 jets ink droplets to the sheet P, which is transported, from the respective ink jet heads 110C, 110M, 110Y, and 110K and records a color image to the recording surface.

Then, the sheet P on which the image has been recorded is subjected to drying processing by the ink drying section 50. The ink drying section 50 blows hot air to the recording surface of the sheet P, which is transported, and performs processing for drying the sheet P.

The sheet P, which has been subjected to drying processing, is transported up to the collection section 60. Then, the sheets P are discharged to the collection section 60 and are collected in the form of a bundle.

<<Structure for Supporting Ink Jet Head by Mount>>

<Structure of Ink Jet Head>

First, the structure of the ink jet heads 110C, 110M, 110Y, and 110K will be described. Since the respective ink jet heads 110C, 110M, 110Y, and 110K have the same structure, the ink jet heads will be described while being denoted by reference numeral 110 in the following description except for a case in which the ink jet heads should be particularly distinguished from each other.

Figure 5:
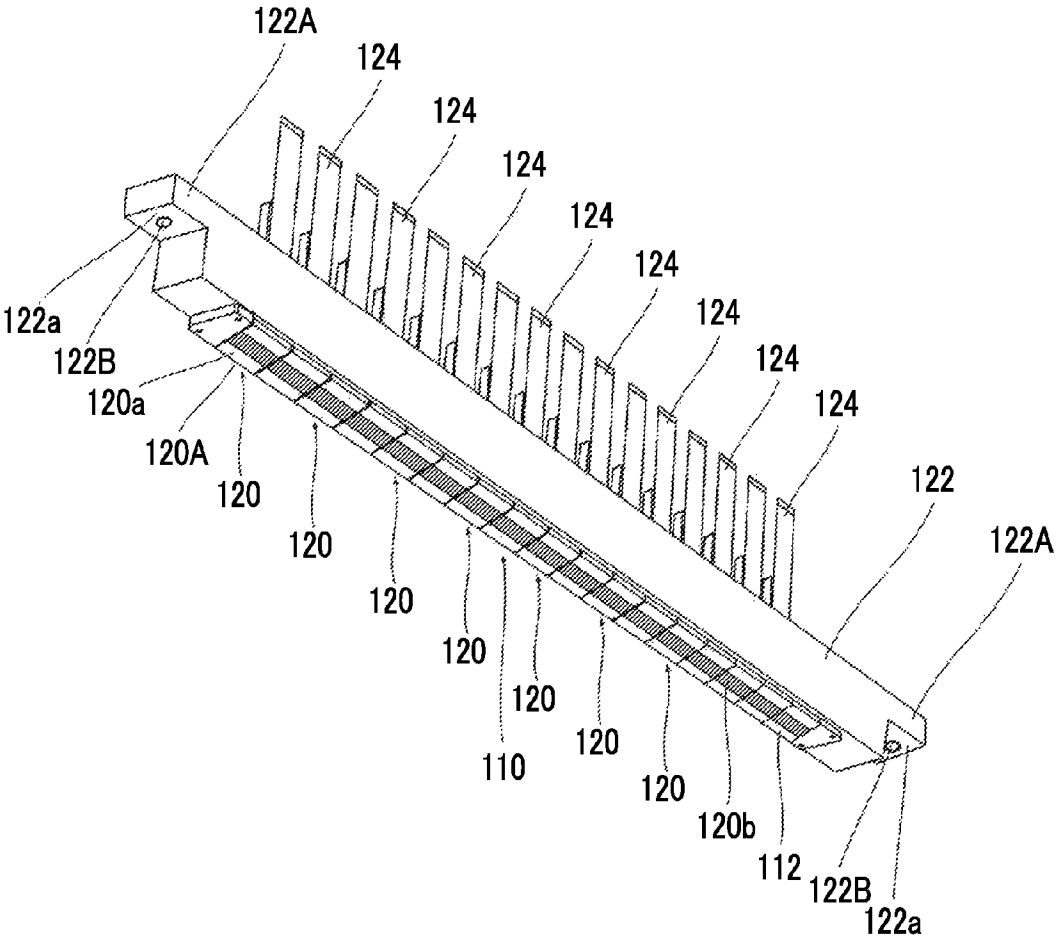
FIG. 5 is a perspective view showing the structure of the ink jet head.

FIG. 5 is a perspective view showing the structure of the ink jet head.

The ink jet head 110 includes a plurality of head modules 120 that are joined in line.

The head module 120 is a so-called short ink jet head. Since the head modules 120 are joined to form one ink jet head, the length of the ink jet head can be easily increased.

Each of the head modules 120 includes a jetting portion 120A at a tip portion thereof. The jetting portion 120A has the shape of a flat parallelogram block. The tip face of the jetting portion 120A forms a nozzle surface 120*a*, and a plurality of nozzles for jetting ink are arranged on the nozzle surface 120*a*. The arrangement of the nozzles will be described below.

The plurality of head modules 120 are mounted on a first supporting frame 122 having the shape of a bar, and are integrated with each other. The first supporting frame 122 includes head module mounting portions (not shown) that are arranged at regular intervals in the longitudinal direction thereof. Each head module 120 is detachably mounted on the head module mounting portion. The respective head modules 120 are mounted on the head module mounting portions, so that the jetting portions 120A are joined in line. Accordingly, since the nozzle surfaces 120*a* of the respective head modules 120 are joined in line, one long nozzle surface 112 is formed as a whole.

Figure 6:
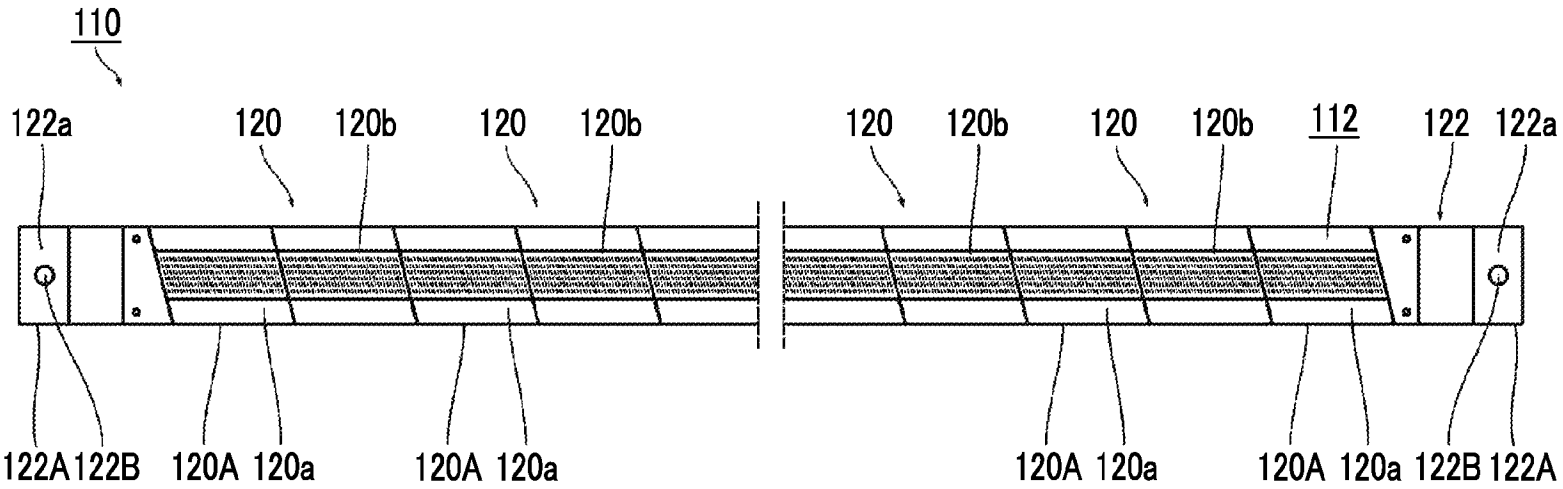
FIG. 6 is a plan view of a nozzle surface of the ink jet head.

FIG. 6 is a plan view of the nozzle surface of the ink jet head.

As shown in FIG. 6, the nozzle surface 120*a* of each head module 120 includes a belt-like nozzle arrangement region 120*b* in the middle portion thereof. Nozzles N are arranged in the nozzle arrangement region 120*b*.

Figure 7:
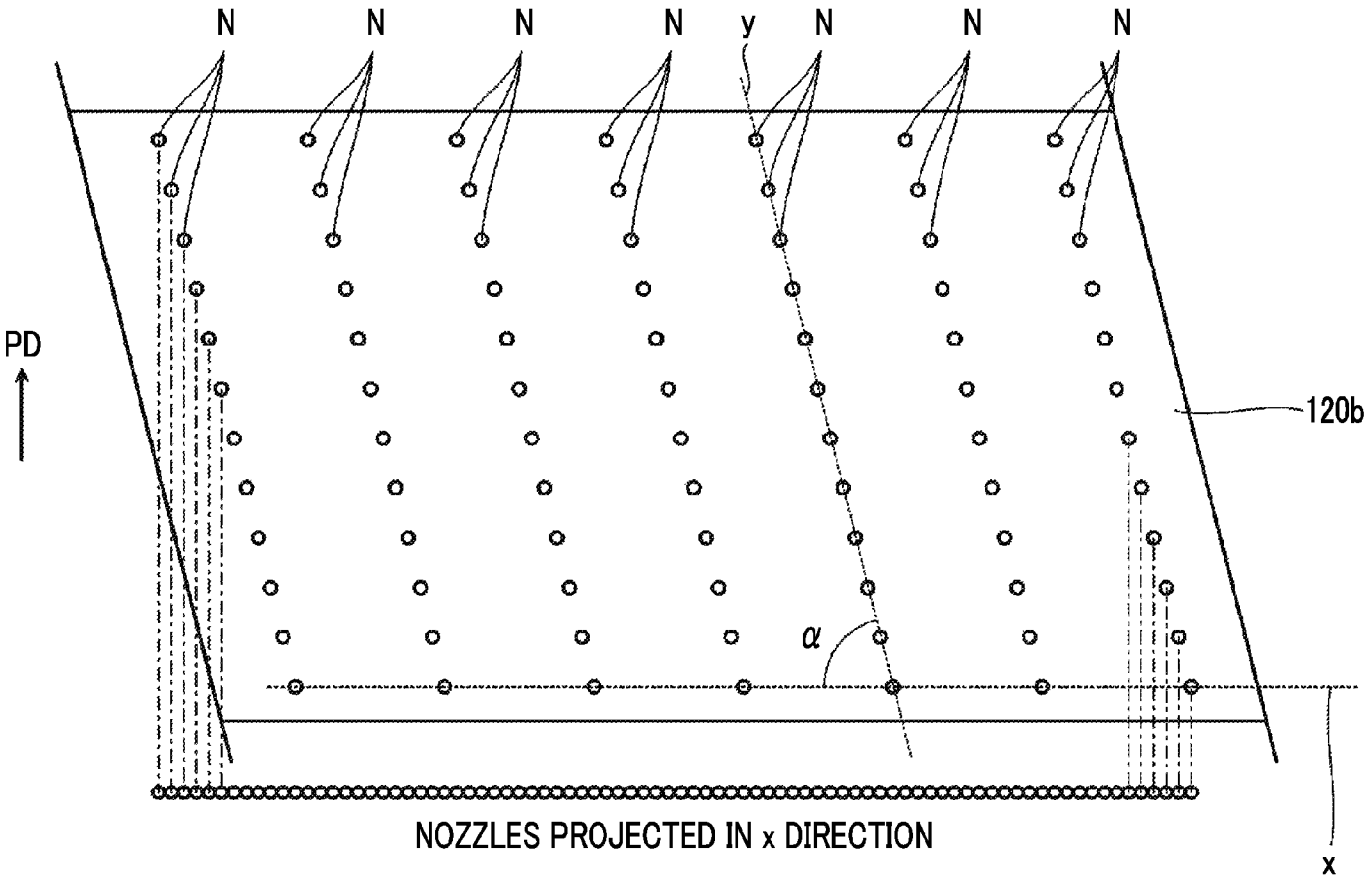
FIG. 7 is an enlarged plan view of a part of a nozzle arrangement region.

FIG. 7 is an enlarged plan view of a part of the nozzle arrangement region.

As shown in FIG. 7, the nozzles N are arranged in the nozzle arrangement region 120*b* in the form of a matrix. In more detail, in a case in which a straight line parallel with the longitudinal direction of the ink jet head 110 is denoted by x and a straight line inclined with respect to the straight line x at an angle $\alpha$ is denoted by y, the nozzles N are arranged at a constant pitch along the straight line x and a constant pitch along the straight line y. Since the nozzles N are arranged in this way, the nozzles N can be densely arranged. A direction in which the nozzles N are substantially arranged in this case is the direction of the straight line x. That is, the nozzles N are substantially arranged in the longitudinal direction of the ink jet head 110.

Ink, which is to be jetted from the nozzles N of the ink jet head 110 having the above-mentioned structure, is circulated and supplied to the ink jet head 110. The supply of ink is performed by an ink supply section. The ink supply section is provided for each ink jet head. The ink supply section circulates and supplies ink to each of the head modules of the ink jet head. Accordingly, each of the head modules is provided with an ink supply port that is used to supply ink and an ink recovery port that is used to recover ink.

<Ink Supply Section>

Figure 8:
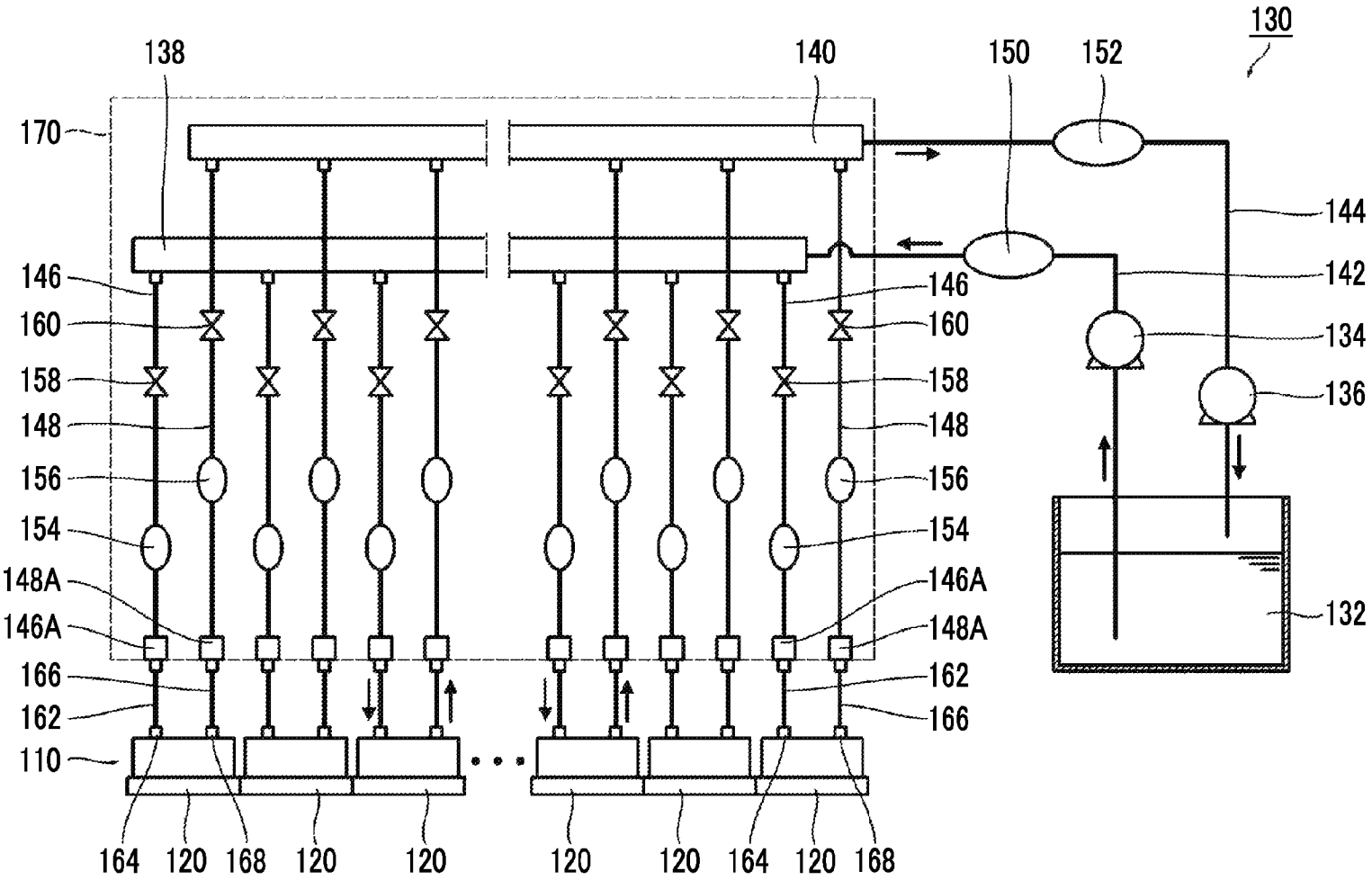
FIG. 8 is a diagram showing the schematic configuration of an ink supply section.

FIG. 8 is a diagram showing the schematic configuration of the ink supply section.

As shown in FIG. 8, the ink supply section 130 includes an ink tank 132 that stores ink, a supply pump 134 that sends the ink to the ink jet heads 110 from the ink tank 132, a recovery pump 136 that sends ink to the ink tank 132 from the ink jet heads 110, a supply manifold 138 that makes the ink sent from the ink tank 132 branch to the respective head modules 120, a recovery manifold 140 that collects the ink individually recovered from the respective head modules 120 together, a common supply pipe 142 that connects the ink tank 132 to the supply manifold 138, a common recovery pipe 144 that connects the ink tank 132 to the recovery manifold 140, individual supply pipes 146 that connect the supply manifold 138 to the respective head modules 120, individual recovery pipes 148 that connect the recovery manifold 140 to the respective head modules 120, a common supply damper 150 that is installed on the common supply pipe 142, a common recovery damper 152 that is installed on the common recovery pipe 144, individual supply dampers 154 that are installed on the respective individual supply pipes 146, individual recovery dampers 156 that are installed on the respective individual recovery pipes 148, individual supply valves 158 that are installed on the respective individual supply pipes 146, and individual recovery valves 160 that are installed on the respective individual recovery pipes 148.

The ink tank 132 stores ink that is jetted from the ink jet heads 110.

The supply pump 134 is formed of, for example, a tube pump and sends the ink, which is stored in the ink tank 132, to the ink jet heads 110 through the common supply pipe 142.

The recovery pump 136 is formed of, for example, a tube pump and sends ink to the ink tank 132 from the ink jet heads 110 through the common recovery pipe 144.

The supply manifold 138 connects the common supply pipe 142 to the individual supply pipes 146. The supply manifold 138 makes the ink, which is sent from the common supply pipe 142, branch and sends the ink to the respective individual supply pipes 146.

The recovery manifold 140 connects the common recovery pipe 144 to the individual recovery pipes 148. The recovery manifold 140 collects the ink, which is sent from the respective individual recovery pipes 148, together and sends the ink to the common recovery pipe 144.

The common supply pipe 142 connects the ink tank 132 to the supply manifold 138.

The common recovery pipe 144 connects the ink tank 132 to the recovery manifold 140.

The individual supply pipes 146 individually connect the supply manifold 138 to the respective head modules 120. Each of the individual supply pipes 146 includes a supply-side connection port 146A at the tip thereof. A flexible individual supply connection pipe 162 is connected to each supply-side connection port 146A. Each of the individual supply pipes 146 is connected to an ink supply port 164, which is provided in each head module 120, through the individual supply connection pipe 162.

The individual recovery pipes 148 individually connect the recovery manifold 140 to the respective head modules 120. Each of the individual recovery pipes 148 includes a recovery-side connection port 148A at the tip thereof. A flexible individual recovery connection pipe 166 is connected to each recovery-side connection port 148A. Each of the individual recovery pipes 148 is connected to an ink recovery port 168, which is provided in each head module 120, through the individual recovery connection pipe 166.

The common supply damper 150 is installed in the middle of the pipe line of the common supply pipe 142. The common supply damper 150 absorbs the pressure variation of ink that flows in the common supply pipe 142. The common supply damper 150 is installed for the main purpose of absorbing the pulsation of ink caused by the driving of the supply pump 134. Accordingly, a large damper, which can absorb a large pressure variation, is used as the common supply damper 150.

The common recovery damper 152 is installed in the middle of the pipe line of the common recovery pipe 144. The common recovery damper 152 absorbs the pressure variation of ink that flows in the common recovery pipe 144. The common recovery damper 152 is installed for the main purpose of absorbing the pulsation of ink caused by the driving of the recovery pump 136. Accordingly, a large damper, which can absorb a large pressure variation, is used as the common recovery damper 152.

The individual supply damper 154 is installed in the middle of the pipe line of each individual supply pipe 146. The individual supply dampers 154 absorbs the pressure variation of ink that flows in each individual supply pipe 146. Each of the individual supply dampers 154 is installed for the main purpose of absorbing the pressure variation of ink caused by the jetting of the ink. Accordingly, a damper, which is smaller than the common supply damper 150, is used as the individual supply damper 154.

The individual recovery damper 156 is installed in the middle of the pipe line of each individual recovery pipe 148. The individual recovery damper 156 absorbs the pressure variation of ink that flows in each individual recovery pipe 148. Each of the individual recovery dampers 156 is installed for the main purpose of absorbing the pressure variation of ink caused by the jetting of the ink. Accordingly, a damper, which is smaller than the common recovery damper 152, is used as the individual recovery damper 156.

The individual supply valve 158 is installed in the middle of the pipe line of each individual supply pipe 146. The individual supply valve 158 is formed of, for example, a solenoid valve, and opens and closes the flow passage for ink that flows in each individual supply pipe 146.

The individual recovery valve 160 is installed in the middle of the pipe line of each individual recovery pipe 148. The individual recovery valve 160 is formed of, for example, a solenoid valve, and opens and closes the flow passage for ink that flows in each individual recovery pipe 148.

The ink supply section 130 having the above-mentioned structure circulates and supplies ink to the ink jet heads 110 by driving the supply pump 134 and the recovery pump 136.

One ink jet head 110 and the ink supply section 130, which supplies ink to the ink jet head 110, form one recording unit. Since the ink jet recording apparatus 1 of this embodiment uses inks having four colors of cyan, magenta, yellow, and black, the ink jet recording apparatus 1 is provided with four recording units.

A part of the ink supply section 130 is mounted on a second supporting frame 170 and is disposed in the vicinity of the ink jet head 110. That is, the supply manifold 138, the recovery manifold 140, the individual supply pipes 146, the individual recovery pipes 148, the individual supply dampers 154, the individual recovery dampers 156, the individual supply valves 158, and the individual recovery valves 160 are mounted on the second supporting frame 170 and are disposed in the vicinity of the ink jet head 110. This will be described below.

<Structure for Supporting Ink Jet Head>

As described above, the respective ink jet heads 110C, 110M, 110Y, and 110K are mounted on the mount provided on the carriage.

Figure 9:
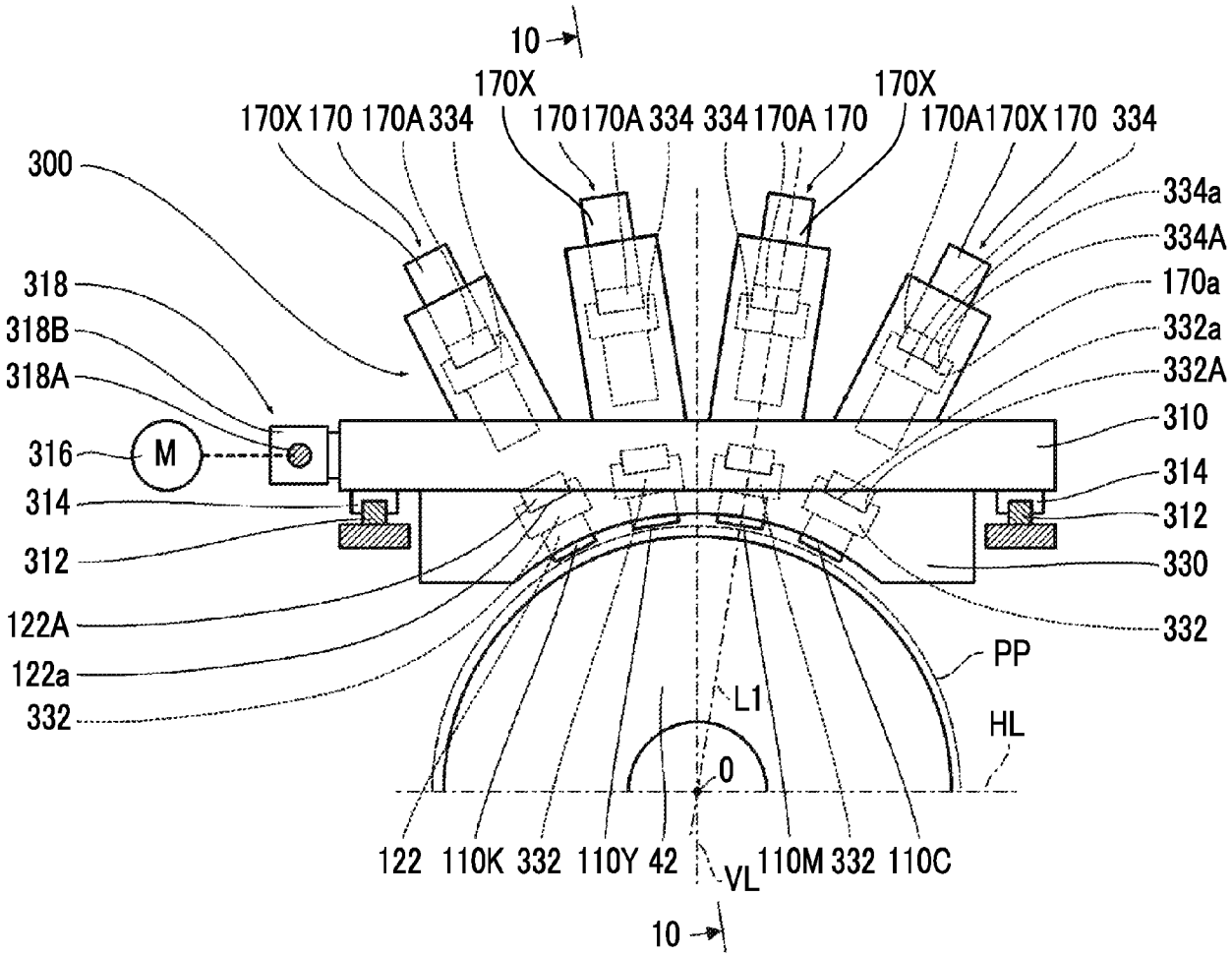
FIG. 9 is a front view of a mount on which the ink jet heads are mounted.
Figure 10:
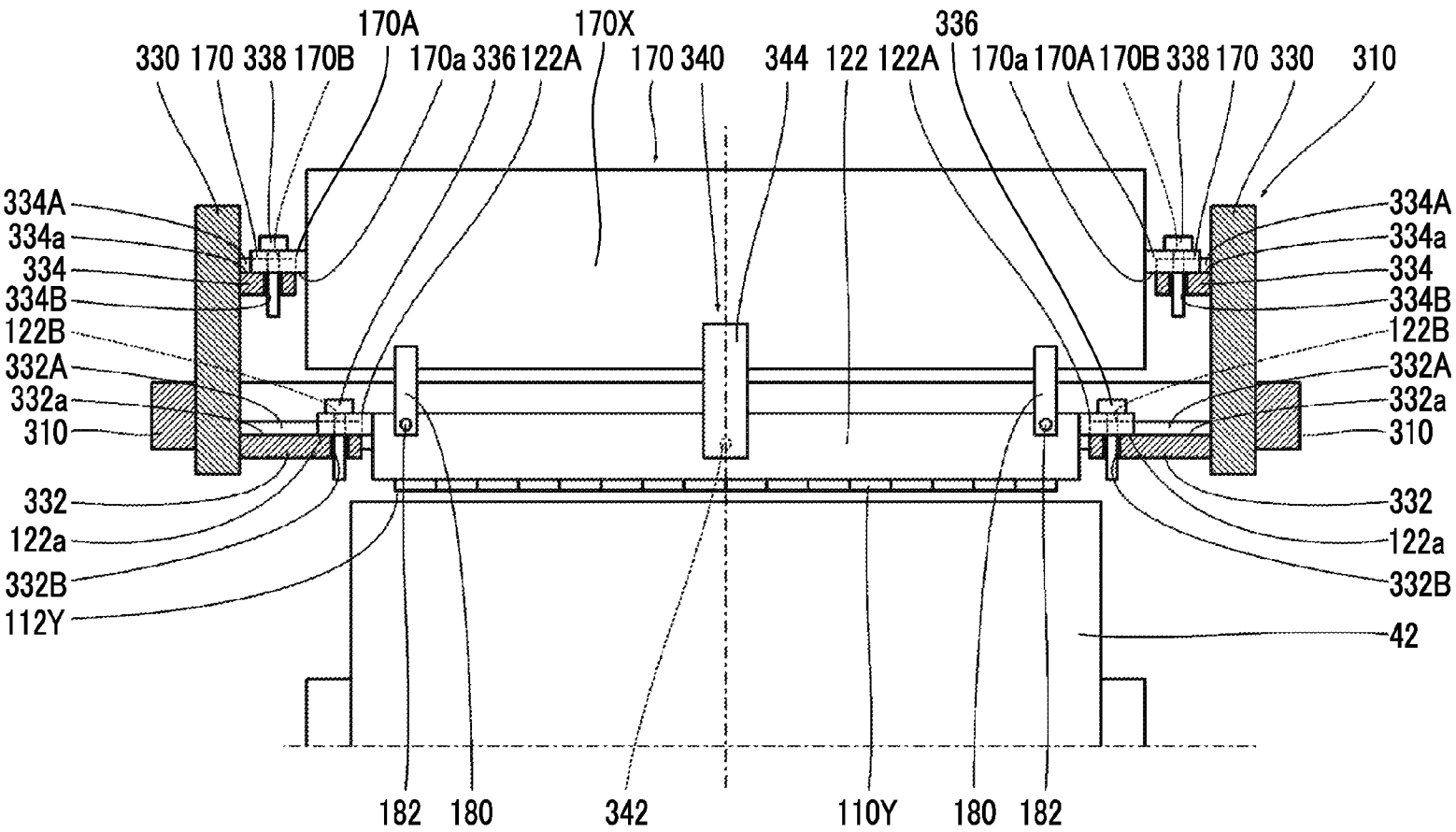
FIG. 10 is a cross-sectional view taken along line 10-10 of FIG. 9.

FIG. 9 is a front view of the mount on which the ink jet heads are mounted. Further, FIG. 10 is a cross-sectional view taken along line 10-10 of FIG. 9.

The mount 300 on which the ink jet heads 110C, 110M, 110Y, and 110K are mounted is provided on the carriage 310.

[Carriage]

The carriage 310 has the shape of a rectangular frame. The carriage 310 is provided to be movable along a pair of guide rails 312. The pair of guide rails 312 is provided in parallel with the rotation axis of the image recording drum 42. The carriage 310 is slidably supported by the pair of guide rails 312 with a pair of sliders 314 interposed therebetween.

The carriage 310 is moved along the guide rails 312 by a feed screw mechanism 318 that is driven by a motor 316. The feed screw mechanism 318 includes a feed screw 318A and a nut 318B that is fitted to the feed screw 318A. The feed screw 318A is disposed along the guide rails 312, and is rotatably supported by bearings (not shown). The nut 318B is connected to the carriage 310. The motor 316 is connected to the feed screw 318A, and rotates the feed screw 318A in a normal direction and a reverse direction.

In a case in which the feed screw 318A is rotated by the motor 316, the nut 318B is moved along the feed screw 318A. As a result, the carriage 310 connected to the nut 318B is moved along the guide rails 312.

[Mount]

The mount 300 supports the first supporting frames 122 and the second supporting frames 170. One first supporting frame 122 and one second supporting frame 170 making a pair form one supporting frame, and are provided for each recording unit. One mount 300 supports a plurality of supporting frames. That is, one mount 300 supports the plurality of first supporting frames 122 and second supporting frames 170.

The mount 300 includes a pair of support plates 330. The pair of support plates 330 is fixedly mounted on the carriage 310. The support plates 330, which are mounted on the carriage 310, are disposed so as to face each other with the image recording drum 42 interposed therebetween.

A pair of first supporting frame bearers 332 and a pair of second supporting frame bearers 334 are provided on the surfaces of the pair of support plates 330 that face each other. The pair of first supporting frame bearers 332 and the pair of second supporting frame bearers 334 are provided for each recording unit, and the first supporting frame bearers 332 and the second supporting frame bearers 334 are arranged in the shape of an arc at regular intervals.

[First Support Frame Bearer]

The pair of first supporting frame bearers 332 is an example of a first supporting frame support, and supports the first supporting frame 122. As described above, the first supporting frame 122 is a frame on which the head modules 120 are mounted.

As shown in FIGS. 5 and 6, first supporting frame-mounting portions 122A are formed at both ends of the first supporting frame 122 in the longitudinal direction of the first supporting frame 122 so as to protrude. Each of the first supporting frame-mounting portions 122A has the shape of a rectangular flat plate, and includes a first supporting frame-mounting surface 122*a* that is parallel with the nozzle surface 112. Further, each of the first supporting frame-mounting portions 122A includes a first supporting frame-mounting hole 122B. The first supporting frame-mounting hole 122B is orthogonal to the first supporting frame-mounting surface 122*a* and is provided so as to pass through the first supporting frame-mounting portion 122A.

As shown in FIG. 10, each of the first supporting frame bearers 332 has the shape of a rectangular flat plate and is provided on the inside of the support plate 330 so as to protrude. Each of the first supporting frame bearers 332 includes a first supporting frame-receiving portion 332A which has a recessed shape and to which the first supporting frame-mounting portion 122A is fitted. The first supporting frame-receiving portion 332A includes a first supporting frame-receiving surface 332*a* that is formed on the bottom of the first supporting frame-receiving portion 332A and is flat.

Further, each of the first supporting frame bearers 332 includes a first supporting frame-fixing hole 332B. The first supporting frame-fixing hole 332B is orthogonal to the first supporting frame-receiving surface 332*a* and is provided so as to pass through the first supporting frame bearer 332.

When the first supporting frame-mounting portions 122A, which are provided at both ends of the first supporting frame 122, are fitted to the first supporting frame-receiving portions 332A of the first supporting frame bearers 332, both ends of the first supporting frame 122 in the longitudinal direction are supported by the first supporting frame bearers 332. Accordingly, the first supporting frame 122 is mounted on the mount 300. The first supporting frame-mounting holes 122B of the first supporting frame-mounting portions 122A of the first supporting frame 122 mounted on the mount 300 are disposed coaxially with the first supporting frame-fixing holes 332B of the first supporting frame bearers 332. When first supporting frame-fixing pins 336 are inserted into the first supporting frame-mounting holes 122B and the first supporting frame-fixing holes 332B, the first supporting frame 122 is positioned on and fixed to the first supporting frame bearers 332.

Incidentally, as described above, the respective ink jet heads 110C, 110M, 110Y, and 110K are arranged in the shape of an arc at regular intervals along the transport path PP of a sheet P. For this reason, the respective first supporting frame bearers 332 are arranged in the shape of an arc at regular intervals so as to correspond to the installation intervals of the ink jet heads 110C, 110M, 110Y, and 110K that are supported by the first supporting frame bearers 332. Further, the respective first supporting frame bearers 332 are obliquely installed so as to correspond to the installation angles of the ink jet heads 110C, 110M, 110Y, and 110K that are supported by the first supporting frame bearers 332. That is, the first supporting frame-receiving surfaces 332*a* are obliquely installed so as to correspond to the inclination angle of the nozzle surface of each ink jet head that is supported by the first supporting frame-receiving surfaces 332*a*. Accordingly, in a case in which the first supporting frames 122 are supported by the first supporting frame bearers 332, the respective ink jet heads 110C, 110M, 110Y, and 110K supported by the first supporting frames 122 are arranged in the shape of an arc at regular intervals along the transport path PP of a sheet P.

[Second Supporting Frame Bearer]

The pair of second supporting frame bearers 334 is an example of a second supporting frame support, and supports the second supporting frame 170. As described above, the second supporting frame 170 supports a part of the ink supply section 130. Specifically, the second supporting frame 170 supports the supply manifold 138, the recovery manifold 140, the individual supply pipes 146, the individual recovery pipes 148, the individual supply dampers 154, the individual recovery dampers 156, the individual supply valves 158, and the individual recovery valves 160 (see FIG. 8). In addition, a drive board for driving the ink jet head 110, sensors, and the like are mounted on the second supporting frame 170. These are members that should be preferably disposed in the vicinity of the ink jet head 110.

In FIG. 5, reference numeral 124 denotes electrical wires that extend from the respective head modules 120. The electrical wires 124 are connected to the drive board that is supported by the second supporting frame 170.

The second supporting frame 170 includes a long second supporting frame body 170X. The respective members of the ink supply section 130 are mounted on the second supporting frame body 170X.

The second supporting frame body 170X includes second supporting frame-mounting portions 170A at both ends thereof in the longitudinal direction thereof. Each of the second supporting frame-mounting portions 170A has the shape of a rectangular flat plate, and includes a second supporting frame-mounting surface 170*a* that is flat. Further, each of the second supporting frame-mounting portions 170A includes a second supporting frame-mounting hole 170B. The second supporting frame-mounting hole 170B is orthogonal to the second supporting frame-mounting surface 170*a* and is provided so as to pass through the second supporting frame-mounting portion 170A.

As shown in FIG. 10, each of the second supporting frame bearers 334 has the shape of a rectangular flat plate and is provided on the inside of the support plate 330 so as to protrude. Each of the second supporting frame bearers 334 includes a second supporting frame-receiving portion 334A which has a recessed shape and to which the second supporting frame-mounting portion 170A is fitted. The second supporting frame-receiving portion 334A includes a second supporting frame-receiving surface 334*a* that is formed on the bottom of the second supporting frame-receiving portion 334A and is flat.

Further, each of the second supporting frame bearers 334 includes a second supporting frame-fixing hole 334B. The second supporting frame-fixing hole 334B is orthogonal to the second supporting frame-receiving surface 334*a* and is provided so as to pass through the second supporting frame bearer 334.

When the second supporting frame-mounting portions 170A, which are provided at both ends of the second supporting frame 170, are fitted to the second supporting frame-receiving portion 334A of the second supporting frame bearers 334, both ends of the second supporting frame 170 in the longitudinal direction are supported by the second supporting frame bearers 334. Accordingly, the second supporting frame 170 is mounted on the mount 300. The second supporting frame-mounting hole 170B of the second supporting frame-mounting portions 170A of the second supporting frame 170 mounted on the mount 300 are disposed coaxially with the second supporting frame-fixing holes 334B of the second supporting frame bearers 334. When second supporting frame-fixing pins 338 are inserted into the second supporting frame-mounting holes 170B and the second supporting frame-fixing holes 334B, the second supporting frame 170 is positioned on and fixed to the second supporting frame bearers 334.

Here, the respective second supporting frame bearers 334 are arranged in the shape of an arc at the same intervals as the intervals of the first supporting frame bearers 332. Specifically, in a case in which a straight line passing through the center O of rotation of the image recording drum 42 and the center of the first supporting frame-receiving surface 332*a* of the first supporting frame bearer 332 is denoted by L1, the second supporting frame bearers 334 are arranged on the straight line L1. Further, the second supporting frame bearers 334 are arranged so that the second supporting frame-receiving surface 334*a* of the second supporting frame bearer 334 is orthogonal to the straight line L1 and the straight line L1 passes through the center of the second supporting frame-receiving surface 334*a*.

Accordingly, in a case in which the second supporting frame 170 is supported by the second supporting frame bearers 334, the first supporting frames 122 and the second supporting frames 170 are disposed in series on the same straight line.

The first supporting frame-receiving surfaces 332*a* of the first supporting frame bearers 332 are provided to be orthogonal to the straight line L1. Accordingly, in a case in which the first supporting frame 122 is supported by the first supporting frame bearers 332, the nozzle surface 112 of the ink jet head 110 supported by the first supporting frame 122 is also disposed to be orthogonal to the straight line L1. The direction of the straight line L1 is the same direction as the ink jetting direction of the ink jet head 110. Accordingly, in a case in which the first supporting frame 122 is supported by the first supporting frame bearers 332 and the second supporting frame 170 is supported by the second supporting frame bearers 334, the first supporting frames 122 and the second supporting frames 170 are disposed in series in the ink jetting direction of the ink jet head 110.

[Connection Mechanism]

As shown in FIG. 10, connecting arms 180, which are to be connected to the first supporting frame 122, are provided at both end portions of the second supporting frame 170 in the longitudinal direction of the second supporting frame 170. The connecting arms 180 are an example of a connecting member. Each of the connecting arms 180 is connected to the first supporting frame 122 by a pin 182.

[Bending Correction Mechanism]

As shown in FIG. 10, the second supporting frame 170 is provided with a bending correction mechanism 340 that corrects the bending of the first supporting frame 122. The bending correction mechanism 340 is an example of bending correction unit.

As described above, the first supporting frame 122 is mounted on the mount 300 while both end portions of the first supporting frame 122 in the longitudinal direction are supported by the first supporting frame bearers 332. In a case in which the long first supporting frame 122 is supported in this way, the middle portion of the first supporting frame 122 is bent by its own weight. For this reason, warpage occurs. The bending correction mechanism 340 applies a pressing force to the first supporting frame 122 to correct the bending of the first supporting frame 122.

Figure 11:
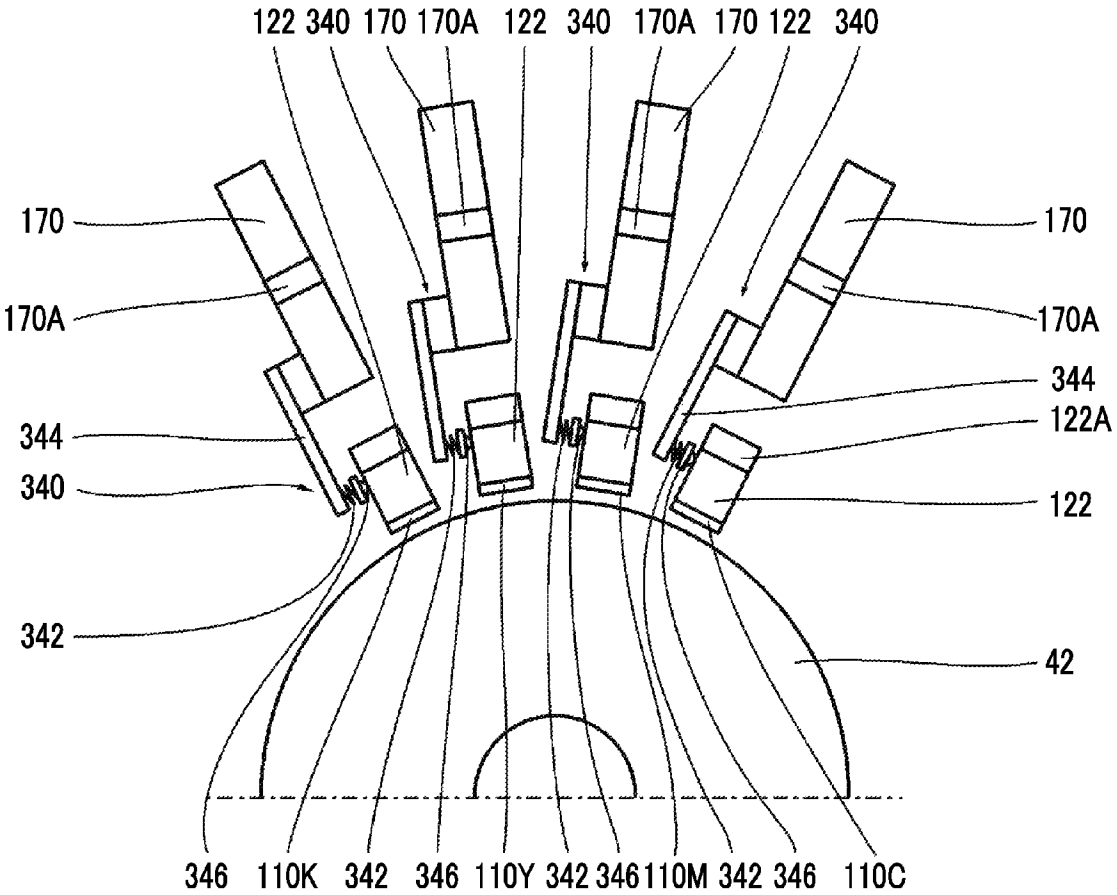
FIG. 11 is a front view showing the schematic structure of a bending correction mechanism.
Figure 12:
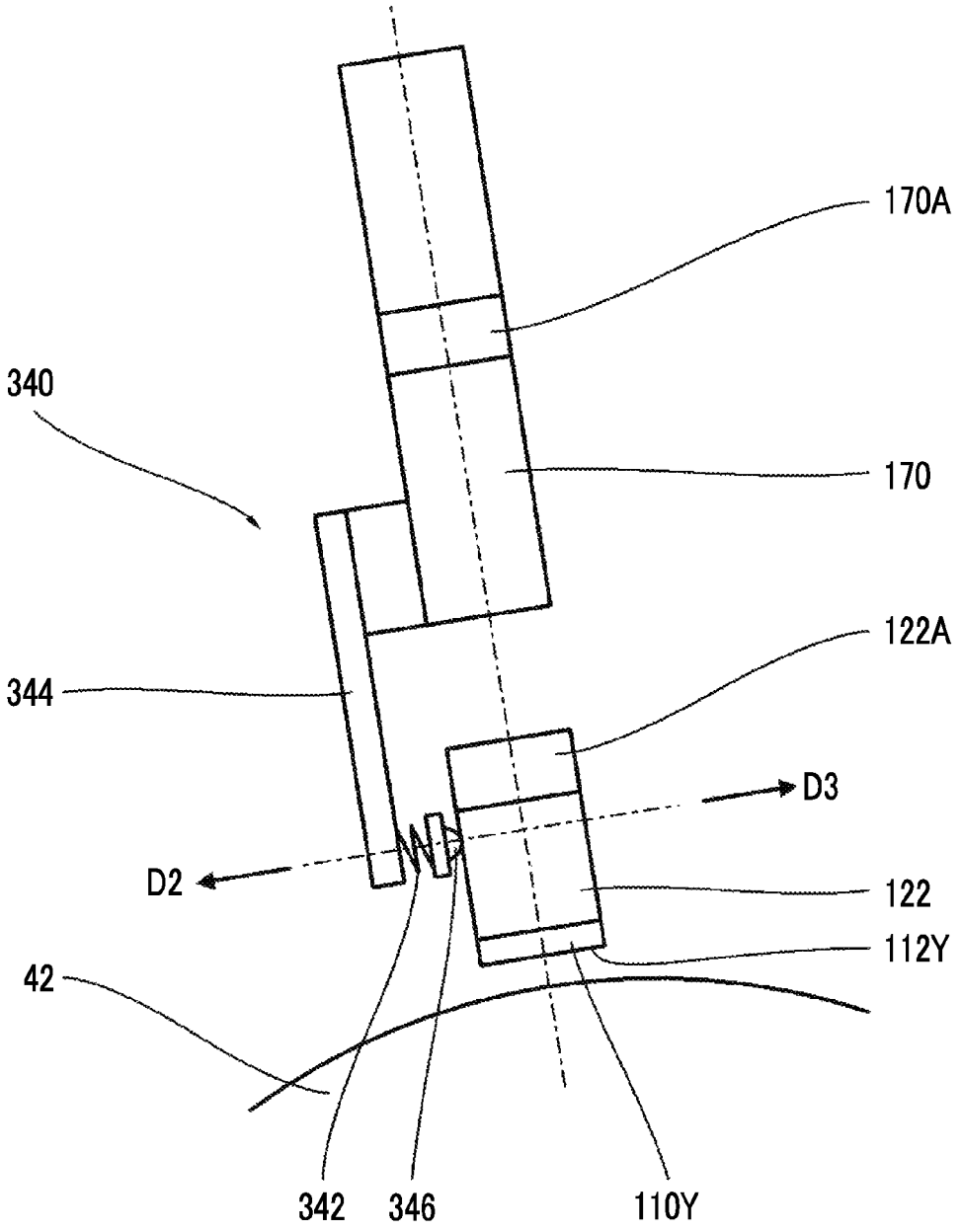
FIG. 12 is an enlarged view of the bending correction mechanism.

FIG. 11 is a front view showing the schematic structure of the bending correction mechanism. Further, FIG. 12 is an enlarged view of the bending correction mechanism.

The bending correction mechanism 340 includes a pressing spring 342, and applies a pressing force, which is generated by the pressing spring 342, to the first supporting frame 122.

The pressing spring 342 is provided on a pressing spring support 344 that is provided on the second supporting frame 170. The pressing spring support 344 has the shape of a long flat plate, and a base end portion of the pressing spring support 344 is fixed to the second supporting frame 170. The pressing spring 342 is provided at a tip portion of the pressing spring support 344.

The pressing spring 342 includes a hemispherical contactor 346 at the tip portion thereof. The bending correction mechanism 340 makes the contactor 346 be in contact with the first supporting frame 122 and applies a pressing force, which is generated by the pressing spring 342, to the first supporting frame 122.

Here, a position at which the contactor 346 is in contact with the first supporting frame 122 is set to a position at which bending can be corrected. In a case in which both ends of the first supporting frame 122 in the longitudinal direction are supported, a position at which the bending of the first supporting frame 122 is largest is the middle portion of the first supporting frame 122 in the longitudinal direction. Accordingly, in a case in which only one portion of the first supporting frame 122 is to be pressed, it is preferable that the contactor 346 is in contact with the middle portion of the first supporting frame 122 in the longitudinal direction or the vicinity thereof.

Further, a direction in which a pressing force is applied is also set to a direction in which bending can be corrected. Specifically, a direction in which a pressing force is applied is set to a direction in which bending is cancelled. In this embodiment, as shown in FIG. 12, a pressing force in a direction D3 opposite to an inclination direction D2 of the ink jet head 110 is applied for the main purpose of correcting bending caused by the oblique installation of the ink jet head 110.

In a case in which each of the ink jet heads 110C, 110M, 110Y, and 110K is obliquely installed as in the ink jet recording apparatus 1 of this embodiment, the bending of the first supporting frame 122 varies for every ink jet head 110C, 110M, 110Y, and 110K. Accordingly, the directions of the pressing forces, which are applied by the pressing springs 342, are individually set for the first supporting frames 122.

Further, the magnitude of a pressing force to be applied is also set according to the degree of the bending of each first supporting frame 122. Since the bending of the first supporting frame 122 varies for every first supporting frame 122 as described above, the magnitude of a force required for correction also varies. Accordingly, the magnitudes of the pressing forces, which are applied by the pressing springs 342, are also individually set for every first supporting frame 122.

<Action of Structure for Supporting Ink Jet Head>

According to the structure for supporting the ink jet head 110 that is adapted as described above, the ink jet head 110 is supported by the first supporting frame 122 and is installed on the mount 300 through the first supporting frame 122.

The mount 300 includes the first supporting frame bearers 332 as the first supporting frame support, supports both ends of the first supporting frame 122 in the longitudinal direction by the first supporting frame bearers 332, and supports the ink jet head 110 with a predetermined posture at a predetermined position.

Incidentally, in a case in which both ends of the first supporting frame 122 are supported in this way and the ink jet head 110 is mounted on the mount 300, there is a concern that the first supporting frame 122 may be bent by its own weight.

However, since the ink jet recording apparatus 1 of this embodiment is provided with the bending correction mechanism 340 that corrects the bending of the first supporting frame 122, the ink jet recording apparatus 1 can effectively prevent the first supporting frame 122 from being bent.

The bending correction mechanism 340 is provided on the second supporting frame 170, and presses the first supporting frame 122 by the pressing spring 342 to correct the bending of the first supporting frame 122. Accordingly, since the bending of the first supporting frame 122 can be prevented even in a case in which both ends of the first supporting frame 122 in the longitudinal direction are supported, a high-quality image can be recorded.

Further, since the bending correction mechanism 340 is provided on the second supporting frame 170, the structure of the mount can be simplified. Accordingly, since the installation interval between the respective ink jet heads can be reduced, a part on which the ink jet heads are to be installed can be made compact.

Furthermore, since the first supporting frame 122 that is a frame supporting the ink jet head 110 and the second supporting frame 170 that is a frame supporting the ink supply section 130 and the like are separated from each other, the first supporting frame 122 that is a frame supporting the ink jet head 110 can be reduced in weight. Accordingly, it is possible to effectively prevent the first supporting frame 122, which is a frame supporting the ink jet head 110, from being bent.

<Method of Setting Pressing Force>

As described above, the magnitudes and directions of the pressing forces, which are to be applied to the first supporting frame 122, are set according to the bending of the first supporting frame 122. For example, a predetermined test chart is printed to measure the bending of the first supporting frame 122. The magnitudes and directions of pressing forces, which are applied to correct bending, are adjusted on the basis of the results of measurement.

The adjustment of every ink jet head can also be performed independently of each other according to predetermined reference, but the adjustment of the ink jet heads can also be performed so that the distribution of landing positions is the same between the respective ink jet heads. For example, one color as a reference is selected, and the bending of the first supporting frame 122 of each ink jet head 110 is corrected so that the distribution of landing positions of each ink jet head becomes the same as the distribution of landing positions of the ink jet head corresponding to the selected color. For example, in a case in which the ink jet head corresponding to cyan is selected as a reference, the bending of the first supporting frame 122 of each of the ink jet heads corresponding to magenta, yellow, and black is corrected so that the distribution of landing positions of each of the ink jet heads corresponding to magenta, yellow, and black becomes the same as the distribution of landing positions of the ink jet head corresponding to cyan.

Modification Example

The bending correction mechanism 340 has been adapted to press one portion of the first supporting frame 122 in the above-mentioned embodiment, but can also be adapted to press a plurality of portions of the first supporting frame 122.

Figure 13:
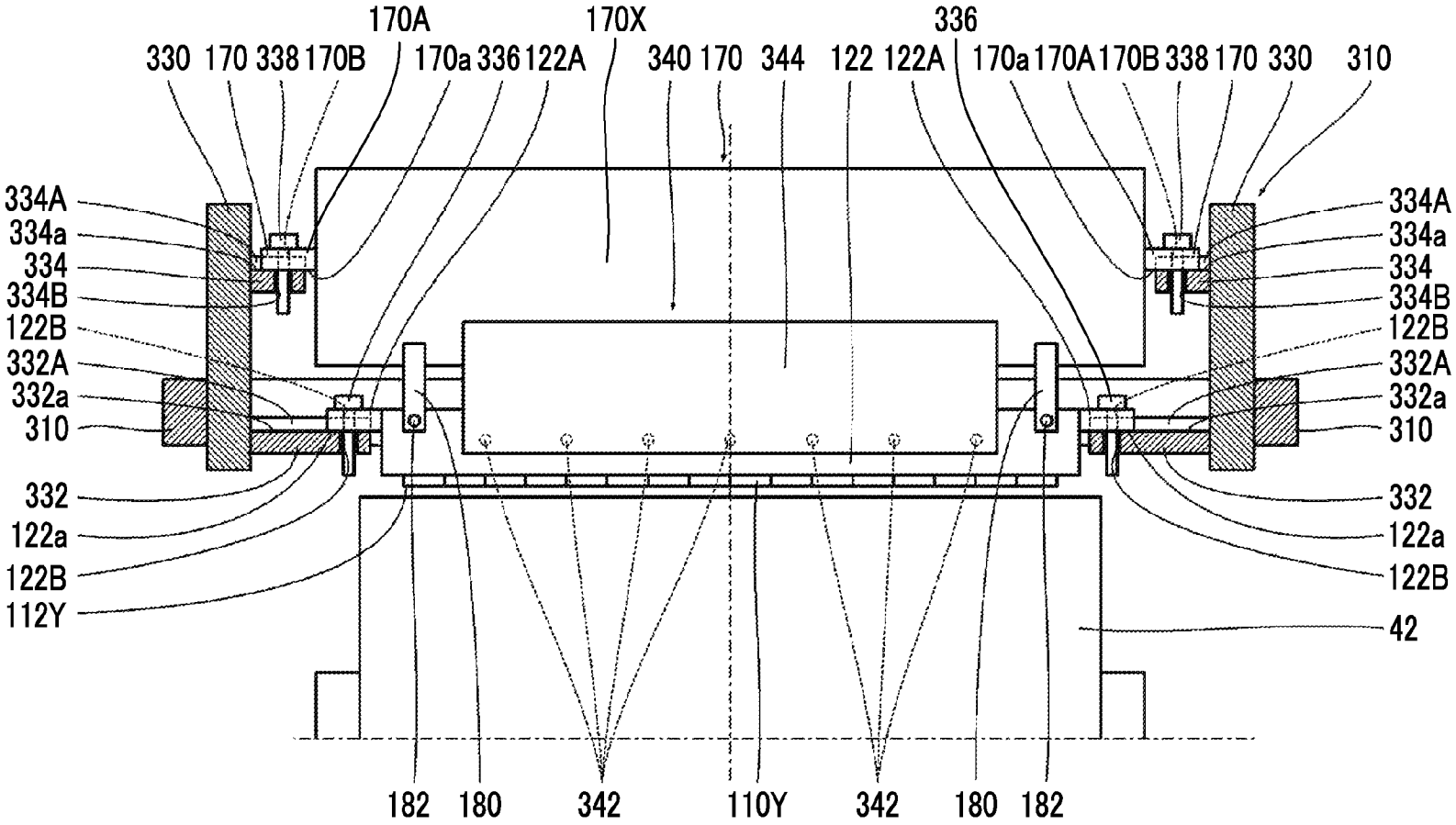
FIG. 13 is a diagram showing the schematic structure of the bending correction mechanism in a case in which a plurality of portions of a first supporting frame are pressed to correct bending.

FIG. 13 is a diagram showing the schematic structure of the bending correction mechanism in a case in which a plurality of portions of the first supporting frame are pressed to correct bending.

In an example shown in FIG. 13, the bending correction mechanism 340 includes a plurality of pressing springs 342 and is adapted to press a plurality of portions of the first supporting frame 122 to correct the bending of the first supporting frame 122.

The respective pressing springs 342 are arranged on the same straight line in the longitudinal direction of the first supporting frame 122, and are arranged so as to be symmetrical with respect to the middle of the first supporting frame 122 in the longitudinal direction.

The respective pressing springs 342 press the first supporting frame 122 in the same direction through contactors (not shown). That is, the respective pressing springs 342 press the first supporting frame 122 in a direction opposite to the inclination direction of the ink jet head 110 that is supported by the first supporting frame 122.

The pressing forces of the respective pressing springs 342 are individually set. In this case, the pressing force of the pressing spring 342, which is disposed in the middle of the bending correction mechanism 340 in the longitudinal direction, is set to be largest and the pressing forces of the pressing springs 342 are set to be reduced toward both ends of the bending correction mechanism 340.

Second Embodiment

Figure 14:
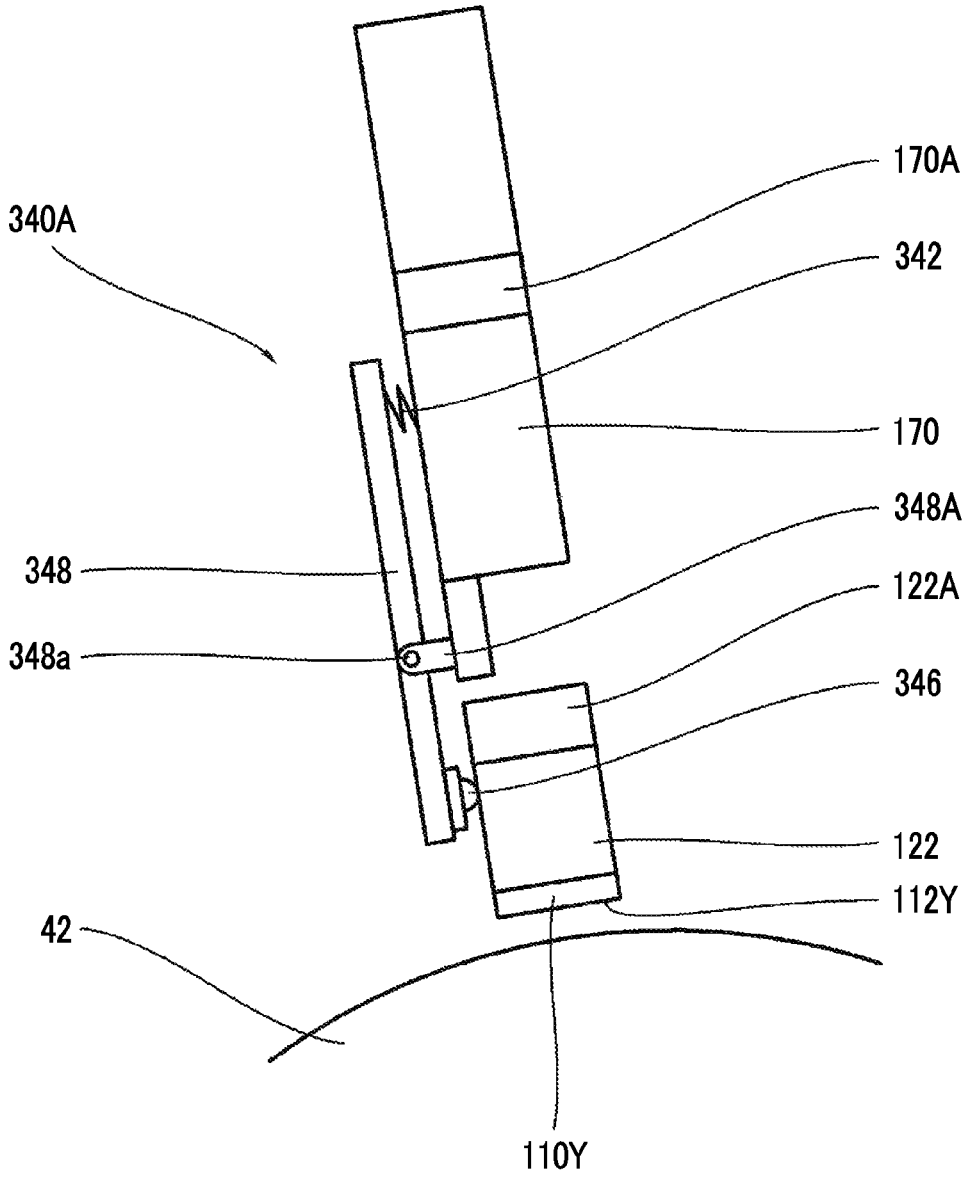
FIG. 14 is a front view showing a second embodiment of the bending correction mechanism.

FIG. 14 is a front view showing a second embodiment of the bending correction mechanism.

The force of the pressing spring 342 has been directly applied to the first supporting frame 122 in the above-mentioned embodiment, but the force of the pressing spring 342 is applied to the first supporting frame 122 by using the principle of the lever in a bending correction mechanism 340A of this embodiment.

As shown in FIG. 14, the bending correction mechanism 340A includes a lever 348. The lever 348 is supported by a lever support 348A, which is provided on the second supporting frame 170, so as to freely oscillate.

The lever support 348A includes an oscillating shaft 348*a* that is set in parallel with the rotation axis of the image recording drum 42. The lever 348 is supported so as to freely oscillate about the oscillating shaft 348*a* as a fulcrum.

A pressing spring 342 is provided at a base end portion of the lever 348. One end of the pressing spring 342 is fixed to the second supporting frame 170 and the other end thereof is fixed to the base end portion of the lever 348, so that the pressing spring 342 applies a pressing force to the lever 348. This pressing force is a force that rotates the lever 348 counterclockwise in FIG. 14.

A contactor 346 is provided at the tip of the lever 348. The contactor 346 is in pressure contact with the first supporting frame 122, so that a pressing force is applied to the first supporting frame 122.

In this way, a pressing force can be applied to the first supporting frame 122 by using the lever. Since the principle of the lever is used, the force of the pressing spring 342 can be efficiently used to correct the bending of the first supporting frame 122.

Third Embodiment

Figure 15:
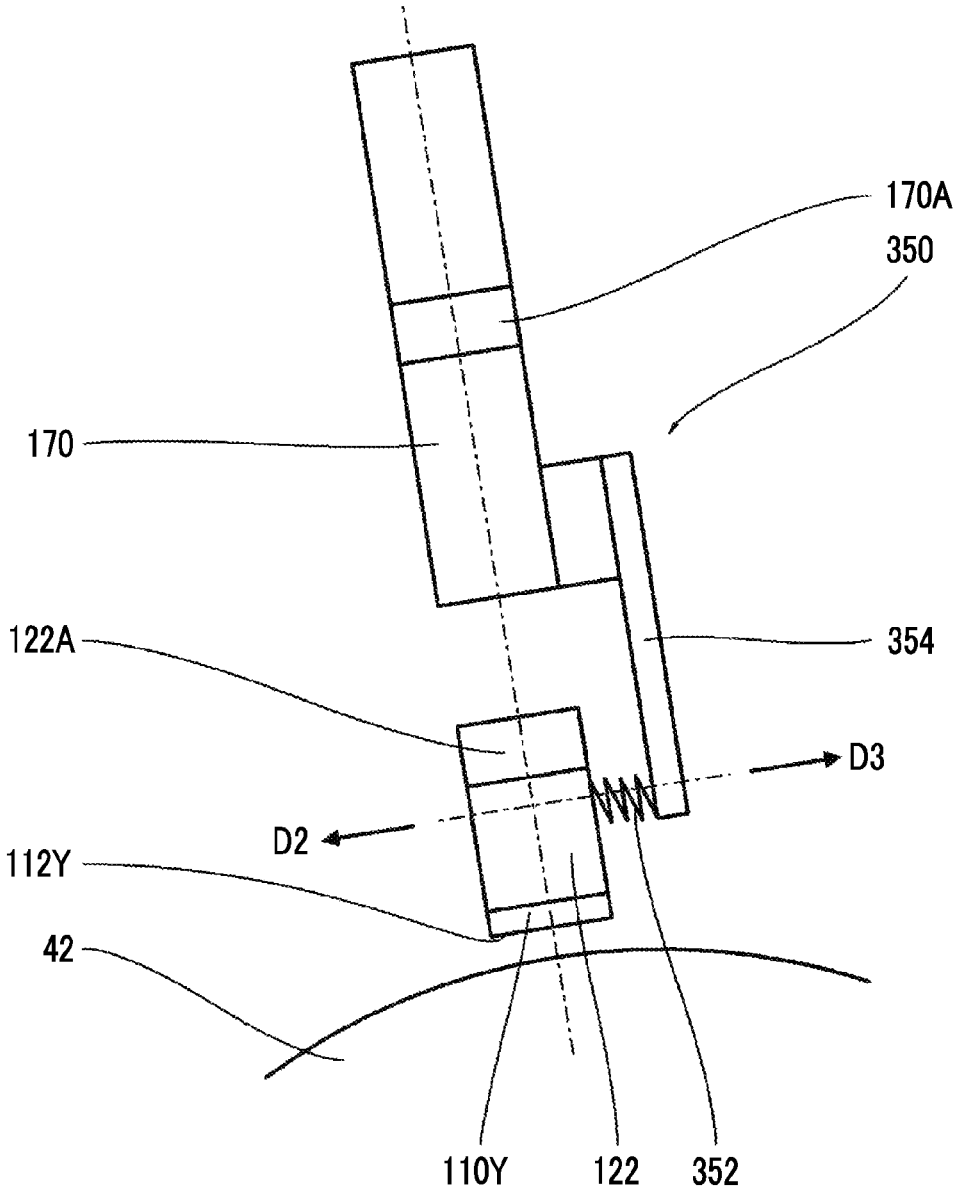
FIG. 15 is a front view showing a third embodiment of the bending correction mechanism.

FIG. 15 is a front view showing a third embodiment of the bending correction mechanism.

As shown in FIG. 15, a bending correction mechanism 350 of this embodiment applies a tensile force to the first supporting frame 122 to correct the bending of the first supporting frame 122.

The bending correction mechanism 350 includes a tension spring 352, and applies a tensile force, which is generated by the tension spring 352, to the first supporting frame 122.

The tension spring 352 is provided on a tension spring support 354 that is provided on the second supporting frame 170. The tension spring support 354 has the shape of a long flat plate, and a base end portion of the tension spring support 354 is fixed to the second supporting frame 170. The tension spring 352 is provided at a tip portion of the tension spring support 354. One end of the tension spring 352 is fixed to the tension spring support 354 and the other end thereof is connected to the first supporting frame 122, so that the tension spring 352 applies a tensile force to the first supporting frame 122.

Here, a position to which a tensile force generated by the tension spring 352 is applied is set to a position at which bending can be corrected. In a case in which a tensile force is applied to only one portion of the first supporting frame 122 as in this example, it is preferable that tensile force is applied to the middle portion of the first supporting frame 122 in the longitudinal direction or the vicinity thereof.

Further, a direction in which a tensile force is applied is also set to a direction in which bending can be corrected. Specifically, a direction in which a tensile force is applied is also set to a direction in which bending is cancelled. In this embodiment, a tensile force in a direction D3 opposite to an inclination direction D2 of the ink jet head 110 is applied for the main purpose of correcting bending caused by the oblique installation of the ink jet head 110. Directions in which tensile forces are to be applied are individually set for the first supporting frames 122.

Further, the magnitude of a tensile force is also set according to the degree of the bending of each first supporting frame 122. Since the bending of the first supporting frame 122 varies for every first supporting frame 122 as described above, the magnitude of a force required for correction also varies. Accordingly, the magnitudes of the tensile forces, which are applied by the tension springs 352, are also individually set for every first supporting frame 122.

A tensile force is applied to the first supporting frame 122 in this way, so that the bending of the first supporting frame 122 can also be corrected. Since the bending correction mechanism 350 is provided on the second supporting frame 170 even in this case, the structure of the mount can be simplified.

One portion has been adapted to be pulled in the above-mentioned embodiments, but a plurality of portions can also be adapted to be pulled.

Further, a tensile force can also be adapted to be applied by using the principle of the lever as in the above-mentioned second embodiment.

Fourth Embodiment

A pressing force or a tensile force has been adapted to be applied to the first supporting frame from the bending correction mechanism provided on the same supporting frame in the above-mentioned embodiments, but a pressing force or a tensile force can also be adapted to be applied to the first supporting frame from a bending correction mechanism provided on the adjacent supporting frame.

Figure 16:
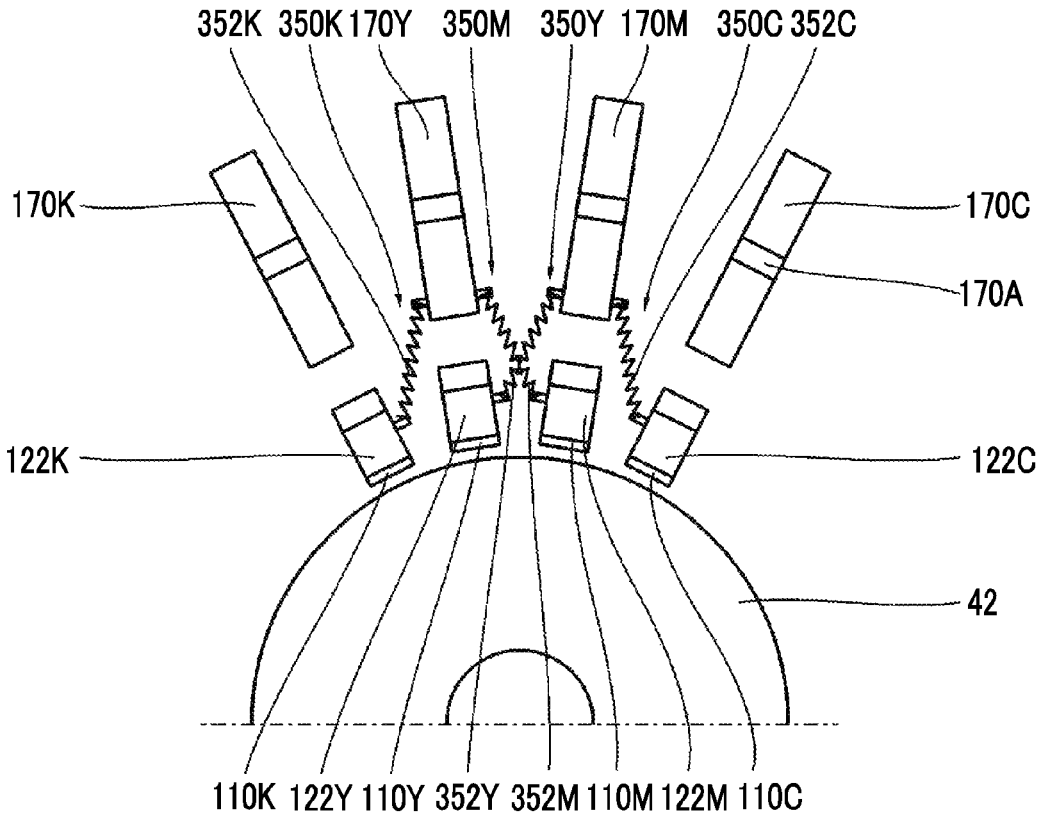
FIG. 16 is a front view showing a schematic structure in a case in which a tensile force is applied to the first supporting frame from a bending correction mechanism provided on an adjacent supporting frame to correct the bending of a first supporting frame.

FIG. 16 is a front view showing a schematic structure in a case in which a tensile force is applied to the first supporting frame from a bending correction mechanism provided on adjacent supporting frame to correct the bending of a first supporting frame.

In FIG. 16, reference numeral 122C denotes a first supporting frame of an ink jet head 110C corresponding to cyan and reference numeral 122M denotes a first supporting frame of an ink jet head 110M corresponding to magenta. Further, reference numeral 122Y denotes a first supporting frame of an ink jet head 110Y corresponding to yellow and reference numeral 122K denotes a first supporting frame of an ink jet head 110K corresponding to black.

Furthermore, reference numeral 170C denotes a second supporting frame of the ink jet head 110C corresponding to cyan and reference numeral 170M denotes a second supporting frame of the ink jet head 110M corresponding to magenta. Moreover, reference numeral 170Y denotes a second supporting frame of the ink jet head 110Y corresponding to yellow and reference numeral 170K denotes a second supporting frame of the ink jet head 110K corresponding to black.

The first supporting frame 122C and the second supporting frame 170C of the ink jet head 110C corresponding to cyan form the supporting frame of the ink jet head 110C corresponding to cyan, and the first supporting frame 122M and the second supporting frame 170M of the ink jet head 110M corresponding to magenta form the supporting frame of the ink jet head 110M corresponding to magenta. Further, the first supporting frame 122Y and the second supporting frame 170Y of the ink jet head 110Y corresponding to yellow form the supporting frame of the ink jet head 110Y corresponding to yellow, and the first supporting frame 122K and the second supporting frame 170K of the ink jet head 110K corresponding to black form the supporting frame of the ink jet head 110K corresponding to black.

Furthermore, in FIG. 16, reference numeral 350C denotes a bending correction mechanism that corrects the bending of the first supporting frame 122C corresponding to cyan and reference numeral 350M denotes a bending correction mechanism that corrects the bending of the first supporting frame 122M corresponding to magenta. Moreover, reference numeral 350Y denotes a bending correction mechanism that corrects the bending of the first supporting frame 122Y corresponding to yellow and reference numeral 350K denotes a bending correction mechanism that corrects the bending of the first supporting frame 122K corresponding to black.

Further, in FIG. 16, reference numeral 352C denotes a tension spring provided on the bending correction mechanism 350C corresponding to cyan and reference numeral 352M denotes a tension spring provided on the bending correction mechanism 350M corresponding to magenta. Furthermore, reference numeral 352Y denotes a tension spring provided on the bending correction mechanism 350Y corresponding to yellow and reference numeral 352K denotes a tension spring provided on the bending correction mechanism 350K corresponding to black.

As shown in FIG. 16, the bending correction mechanism 350C, which corrects the bending of the first supporting frame 122C corresponding to cyan, is provided on the second supporting frame 170M corresponding to magenta and the bending correction mechanism 350M, which corrects the bending of the first supporting frame 122M corresponding to magenta, is provided on the second supporting frame 170Y corresponding to yellow. Further, the bending correction mechanism 350Y, which corrects the bending of the first supporting frame 122Y corresponding to yellow, is provided on the second supporting frame 170M corresponding to magenta and the bending correction mechanism 350K, which corrects the bending of the first supporting frame 122K corresponding to black, is provided on the second supporting frame 170Y corresponding to yellow.

In more detail, one end of the tension spring 352C of the bending correction mechanism 350C corresponding to cyan is fixed to the second supporting frame 170M corresponding to magenta and the other thereof is connected to the first supporting frame 122C corresponding to cyan, so that a tensile force is applied to the first supporting frame 122C corresponding to cyan.

Furthermore, one end of the tension spring 352M of the bending correction mechanism 350M corresponding to magenta is fixed to the second supporting frame 170Y corresponding to yellow and the other thereof is connected to the first supporting frame 122M corresponding to magenta, so that a tensile force is applied to the first supporting frame 122M corresponding to magenta.

Moreover, one end of the tension spring 352Y of the bending correction mechanism 350Y corresponding to yellow is fixed to the second supporting frame 170M corresponding to magenta and the other thereof is connected to the first supporting frame 122Y corresponding to yellow, so that a tensile force is applied to the first supporting frame 122Y corresponding to yellow.

Further, one end of the tension spring 352K of the bending correction mechanism 350K corresponding to black is fixed to the second supporting frame 170Y corresponding to yellow and the other thereof is connected to the first supporting frame 122K corresponding to black, so that a tensile force is applied to the first supporting frame 122K corresponding to black.

In this way, a tensile force can also be adapted to be applied to the first supporting frame from the bending correction mechanism provided on the adjacent supporting frame.

A case in which a tensile force is applied to the first supporting frame from the bending correction mechanism provided on the adjacent supporting frame has been described in this example by way of example, but a pressing force can also be adapted to be applied to the first supporting frame from the bending correction mechanism provided on the adjacent supporting frame.

Figure 17:
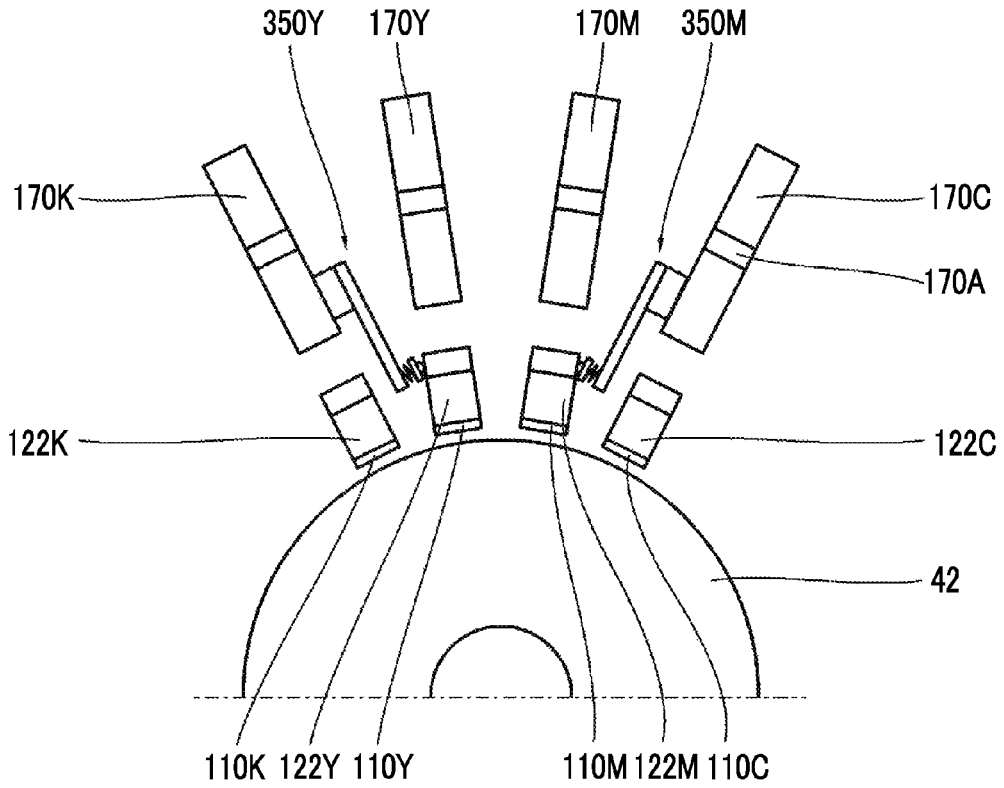
FIG. 17 is a diagram showing a schematic structure in a case in which a pressing force is applied to a first supporting frame from a bending correction mechanism provided on an adjacent supporting frame.

FIG. 17 is a diagram showing a schematic structure in a case in which a pressing force is applied to the first supporting frame from the bending correction mechanism provided on the adjacent supporting frame.

In an example shown in FIG. 17, the bending correction mechanism 350M, which corrects the bending of the first supporting frame 122M corresponding to magenta, is provided on the second supporting frame 170C corresponding to cyan and a pressing force is adapted to be applied to the first supporting frame 122M, which corresponds to magenta, by the bending correction mechanism 350M provided on the second supporting frame 170C corresponding to cyan. Further, the bending correction mechanism 350Y, which corrects the bending of the first supporting frame 122Y corresponding to yellow, is provided on the second supporting frame 170K corresponding to black and a pressing force is adapted to be applied to the first supporting frame 122Y, which corresponds to yellow, by the bending correction mechanism 350Y provided on the second supporting frame 170K corresponding to black.

The bending correction mechanism that corrects the bending of the first supporting frame 122C corresponding to cyan and the bending correction mechanism that corrects the bending of the first supporting frame 122K corresponding to black are not shown in the example shown in FIG. 17. However, for example, the bending correction mechanism, which corrects the bending of the first supporting frame 122C corresponding to cyan, may be provided on the second supporting frame corresponding to cyan and may be provided on the second supporting frame corresponding to magenta. Likewise, the bending correction mechanism, which corrects the bending of the first supporting frame 122K corresponding to black, may be provided on the second supporting frame 170K corresponding to black, and may be provided on the second supporting frame 170Y corresponding to yellow. In this case, a tensile force may be adapted to be applied to correct bending, and a pressing force may be adapted to be applied to correct bending. That is, a portion at which the bending correction mechanism is installed and a force to be applied can be appropriately combined with each other when used. It is preferable that a portion at which the bending correction mechanism is installed and a force to be applied are selected in consideration of the installation space of the bending correction mechanism and the like.

Fifth Embodiment

Figure 18:
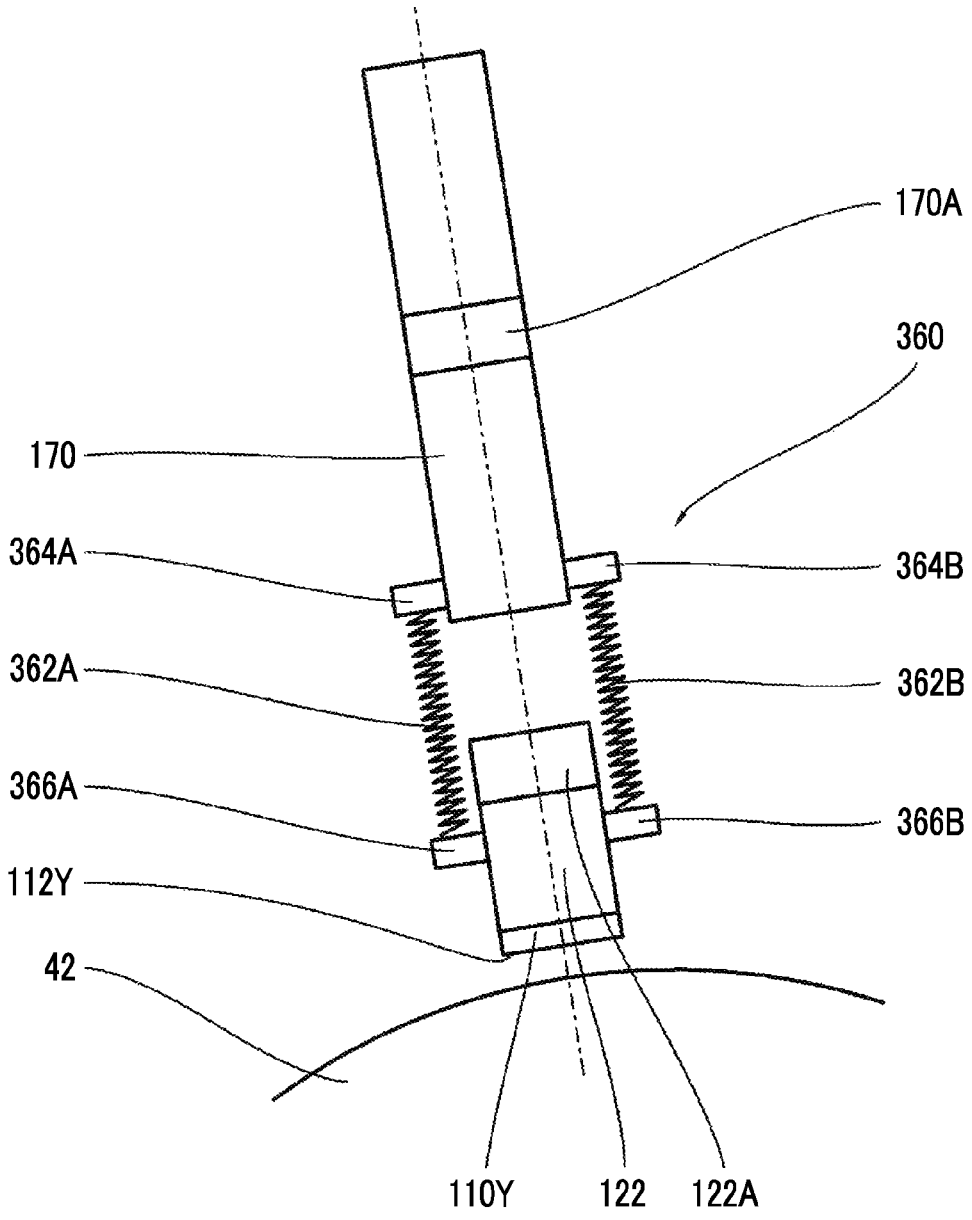
FIG. 18 is a front view showing a fifth embodiment of the bending correction mechanism.

FIG. 18 is a front view showing a fifth embodiment of the bending correction mechanism.

As shown in FIG. 18, a bending correction mechanism 360 of this embodiment applies tensile forces to the first supporting frame 122 from both sides of a first supporting frame 122 in a lateral direction of the first supporting frame 122 to correct the bending of the first supporting frame 122. The lateral direction of the first supporting frame 122 is a direction orthogonal to the longitudinal direction of the first supporting frame 122.

The bending correction mechanism 360 includes a first spring 362A that pulls one end of the first supporting frame 122 in the lateral direction and a second spring 362B that pulls the other end of the first supporting frame 122 in the lateral direction. The first spring 362A and the second spring 362B are disposed so as to be symmetrical with each other with the first supporting frame 122 interposed therebetween.

A second supporting frame 170 is provided with a first spring support 364A to which a base end portion of the first spring 362A is fixed and a second spring support 364B to which a base end portion of the second spring 362B is fixed.

The first spring support 364A and the second spring support 364B are disposed in the middle of the second supporting frame 170 in a longitudinal direction, and are disposed so as to be symmetrical with each other with the second supporting frame 170 interposed therebetween in the lateral direction.

The first supporting frame 122 is provided with a first spring-connecting portion 366A to which a tip of the first spring 362A is connected and a second spring-connecting portion 366B to which a tip of the second spring 362B is connected. The first spring-connecting portion 366A and the second spring-connecting portion 366B are disposed in the middle of the first supporting frame 122 in a longitudinal direction, and are disposed so as to be symmetrical with each other with the first supporting frame 122 interposed therebetween in the lateral direction.

According to the bending correction mechanism 360 of this embodiment having the above-mentioned structure, the first supporting frame 122 is pulled from both sides thereof in the lateral direction by the first spring 362A and the second spring 362B, so that the bending of the first supporting frame 122 is corrected. The pulling direction is a direction opposite to the ink jetting direction.

Since tensile forces are applied in two directions in this way to correct bending, bending can be more appropriately corrected. That is, since the first supporting frame 122 is pulled in two directions, fine adjustment can be performed in regard to the correction of bending. Accordingly, the bending of each first supporting frame 122 can be more appropriately corrected. The fine adjustment is performed by the individual adjustment of the spring constant of the first spring 362A and the spring constant of the second spring 362B.

Only the middle of the first supporting frame 122 in the longitudinal direction has been adapted to be pulled in the above-mentioned embodiments, but a plurality of portions of the first supporting frame 122 can also be adapted to be pulled.

Further, the first supporting frame 122 has been adapted to be pulled in the direction opposite to the ink jetting direction in the above-mentioned embodiments, but can also be adapted to be pulled at an angle.

Other Embodiments

<Ink Jet Head>

A case in which the ink jet head including the plurality of joined head modules is supported has been described in the above-mentioned embodiments by way of example. However, the invention can also be applied to a case in which an ink jet head formed as a single body is supported, likewise.

Further, a case in which a plurality of head modules are arranged in line on the same straight line to form one ink jet head has been described in the above-mentioned embodiments, but the invention can also be applied to a case in which a plurality of head modules are arranged in a zigzag pattern to form one ink jet head.

<Supporting Frame>

A part of the ink supply section and the drive board have been mounted on the second supporting frame in the above-mentioned embodiments, but members to be mounted on the second supporting frame are not limited thereto. Members, which need to be disposed in the vicinity of the ink jet head, can be mounted on the second supporting frame. Accordingly, the support of the ink jet head can be reduced in weight.

Both ends of the second supporting frame in the longitudinal direction have been adapted to be supported by the mount in the above-mentioned embodiments, but the support aspect of the second supporting frame is not limited thereto. Three or more portions of the second supporting frame can also be adapted to be supported.

Further, the first and second supporting frames have been connected to each other by the connecting member in the above-mentioned embodiments, but can also be adapted to be separated from each other. When the first and second supporting frames are connected to each other by the connecting member and are integrated with each other as in the above-mentioned embodiments, the first and second supporting frames can be easily attached to or/and detached from the mount.

Furthermore, in a case in which the first and second supporting frames are to be connected to each other by the connecting member, the first and second supporting frames may be fixedly connected to each other by bolts, welding, or the like and may be movably connected to each other by pins or the like. Moreover, a lock mechanism may be provided in a case in which the first and second supporting frames are to be movably connected to each other.

Further, the materials of the first and second supporting frames, which form the supporting frame, are not particularly limited, and it is preferable that a material having a high stiffness is used as the materials of the first and second supporting frames. Particularly, since the deformation of the first supporting frame directly affects the quality of an image, it is preferable that a material having a high stiffness and a low coefficient of thermal expansion is used as the material of the first supporting frame. For example, Invar can be used as the material of the first supporting frame. On the other hand, since an influence of the second supporting frame on the quality of an image is small, the second supporting frame can be made of metal, such as aluminum or stainless.

<First Supporting Frame Support>

The first supporting frame-fixing pins 336 have been inserted into the first supporting frame-mounting holes 122B of the first supporting frame 122 and the first supporting frame-fixing holes 332B of the first supporting frame bearers 332 in the above-mentioned embodiments, so that the first supporting frame 122 has been fixed to the first supporting frame bearers 332. However, a method of fixing the first supporting frame to the mount is not limited thereto. Both ends of the first supporting frame in the longitudinal direction have only to be supported.

Furthermore, the first supporting frames have been adapted to be fixed to the mount at fixed positions in the above-mentioned embodiments, but a mechanism for moving the supported first supporting frame up and down may be provided. That is, lifting means for moving the first supporting frame support up and down may be provided on the mount.

<Layout of Ink Jet Heads>

The ink jet heads have been arranged in the shape of an arc in the above-mentioned embodiments, but the layout of the ink jet heads is determined depending on means for transporting media. For example, in a case in which media are transported in the form of a straight line, the ink jet heads are arranged in the form of a straight line.

Further, a case in which the ink jet heads for jetting inks having different colors are mounted on one mount has been described in the above-mentioned embodiments by way of example, but the invention can also be applied to a case in which a plurality of ink jet heads for jetting ink having the same color are mounted on one mount.

<Carriage>

The mount has been mounted on the carriage in the above-mentioned embodiments, but the mount can be fixedly installed in the apparatus.

<Application to Other Apparatuses>

A case in which the invention is applied to an ink jet recording apparatus for recording a color image on a general-purpose printing sheet has been described in the above-mentioned embodiments by way of example, but the application of the invention is not limited thereto. In addition to this, for example, the invention can be widely applied to apparatuses for obtaining various shapes or patterns with a liquid functional material, such as a wiring drawing apparatus for drawing a wiring pattern of an electronic circuit by an ink jet method, an apparatus for manufacturing various devices, a resist printing apparatus using resin liquid as functional liquid to be jetted, an apparatus for manufacturing a color filter, and a microstructure forming apparatus for forming a microstructure with a material for material position.

EXPLANATION OF REFERENCES

1: ink jet recording apparatus
10: sheet feeding section
12: sheet feeding device
12A: sheet feed tray
14: feeder board
16: sheet feed drum
20: treatment liquid applying section
22: treatment liquid applying drum
23: gripper
24: treatment liquid applying device
30: treatment liquid drying section
32: treatment liquid drying drum
33: gripper
34: hot air blower
40: image recording section
42: image recording drum
43: gripper
48: scanner
50: ink drying section
52: chain delivery
52A: chain
52B: gripper
54: sheet guide
56: hot air blowing unit
60: collection section
62: collection device
62A: collection tray
70: maintenance section
72: cap device
72C, 72M, 72Y, 72K: cap
74: cleaning device
74C, 74M, 74Y, 74K: cleaner
100: head unit
110: ink jet head
110C: ink jet head corresponding to cyan
110M: ink jet head corresponding to magenta
110Y: ink jet head corresponding to yellow
110K: ink jet head corresponding to black
112: nozzle surface
112C, 112M, 112Y, 112K: nozzle surface
120: head module
120A: jetting portion of head module
120*a*: nozzle surface of head module
120*b*: nozzle arrangement region
122: first supporting frame
122A: first supporting frame-mounting portion
122B: first supporting frame-mounting hole
122C: first supporting frame of ink jet head corresponding to cyan
122M: first supporting frame of ink jet head corresponding to magenta
122Y: first supporting frame of ink jet head corresponding to yellow
122K: first supporting frame of ink jet head corresponding to black
122*a*: first supporting frame-mounting surface
124: electrical wire
130: ink supply section
132: ink tank
134: supply pump
136: recovery pump
138: supply manifold
140: recovery manifold
142: common supply pipe
144: common recovery pipe
146: individual supply pipe
146A: supply-side connection port
148: individual recovery pipe
148A: recovery-side connection port
150: common supply damper
152: common recovery damper
154: individual supply damper
156: individual recovery damper
158: individual supply valve
160: individual recovery valve
162: individual supply connection pipe
164: ink supply port
166: individual recovery connection pipe
168: ink recovery port
170: second supporting frame
170A: second supporting frame-mounting portion
170B: second supporting frame-mounting hole
170X: second supporting frame body
170C: second supporting frame of ink jet head corresponding to cyan
170M: second supporting frame of ink jet head corresponding to magenta
170Y: second supporting frame of ink jet head corresponding to yellow
170K: second supporting frame of ink jet head corresponding to black
170*a*: second supporting frame-mounting surface
180: connecting arm
182: pin
200: computer
202: communication section
204: operation section
206: display section
208: storage section
300: mount
310: carriage
312: guide rail
314: slider
316: motor
318: feed screw mechanism
318A: feed screw
318B: nut
330: support plate
332: first supporting frame bearer

332A: first supporting frame-receiving portion
332B: first supporting frame-fixing hole
332*a*: first supporting frame-receiving surface
334: second supporting frame bearer
334A: second supporting frame-receiving portion
334B: second supporting frame-fixing hole
334*a*: second supporting frame-receiving surface
336: first supporting frame-fixing pin
338: second supporting frame-fixing pin
340: bending correction mechanism
340A: bending correction mechanism
342: pressing spring
344: pressing spring support
346: contactor
348: lever
348A: lever support
348*a*: oscillating shaft
350: bending correction mechanism
350C: bending correction mechanism corresponding to cyan
350M: bending correction mechanism corresponding to magenta
350Y: bending correction mechanism corresponding to yellow
350K: bending correction mechanism corresponding to black
352: tension spring
352C: tension spring of bending correction mechanism corresponding to cyan
352M: tension spring of bending correction mechanism corresponding to magenta
352Y: tension spring of bending correction mechanism corresponding to yellow
352K: tension spring of bending correction mechanism corresponding to black
354: tension spring support
360: bending correction mechanism
362A: first spring
362B: second spring
364A: first spring support
364B: second spring support
366A: first spring-connecting portion
366B: second spring-connecting portion
N: nozzle
P: sheet

What is claimed is:

1. An ink jet recording apparatus comprising:

a plurality of recording units each of which comprises a long ink jet head and an ink supply section supplying ink to the ink jet head;

a plurality of supporting frames each of which comprises a first supporting frame supporting the ink jet head and a second supporting frame supporting at least a part of the ink supply section;

a mount that comprises a plurality of first supporting frame supports supporting both ends of the first supporting frames in a longitudinal direction and a plurality of second supporting frame supports supporting the second supporting frames; and a bending correction unit that are provided on the second supporting frames and apply pressing forces or tensile forces to at least a part of the first supporting frames to correct bending of the first supporting frames in a case in which the first supporting frames are supported by the first supporting frame supports.

2. The ink jet recording apparatus according to claim 1, wherein the ink jet head includes a plurality of joined head modules.

3. The ink jet recording apparatus according to claim 2, wherein the first supporting frame supports are arranged in the shape of an arc along an arc-shaped transport path of a medium that is transported along the transport path.

4. The ink jet recording apparatus according to claim 3, wherein the bending correction unit comprise springs, and apply pressing forces or tensile forces, which are generated by the springs, to the first supporting frames.

5. The ink jet recording apparatus according to claim 3, wherein the bending correction unit comprise first springs each of which pulls one end of the first supporting frame in a lateral direction and second springs each of which pulls the other end of the first supporting frame in the lateral direction.

6. The ink jet recording apparatus according to claim 2, wherein the first and second supporting frames of the supporting frame are connected to each other by a connecting member.

7. The ink jet recording apparatus according to claim 2, wherein the bending correction unit comprise springs, and apply pressing forces or tensile forces, which are generated by the springs, to the first supporting frames.

8. The ink jet recording apparatus according to claim 2, wherein the bending correction unit comprise first springs each of which pulls one end of the first supporting frame in a lateral direction and second springs each of which pulls the other end of the first supporting frame in the lateral direction.

9. The ink jet recording apparatus according to claim 2, wherein the bending correction unit apply tensile forces to the first supporting frames of the supporting frames that are adjacently disposed.

10. The ink jet recording apparatus according to claim 1, wherein the first supporting frame supports are arranged in the shape of an arc along an arc-shaped transport path of a medium that is transported along the transport path.

11. The ink jet recording apparatus according to claim 10, wherein the first and second supporting frames of the supporting frame are connected to each other by a connecting member.

12. The ink jet recording apparatus according to claim 10, wherein the bending correction unit comprise springs, and apply pressing forces or tensile forces, which are generated by the springs, to the first supporting frames.

13. The ink jet recording apparatus according to claim 10, wherein the bending correction unit comprise first springs each of which pulls one end of the first supporting frame in a lateral direction and second springs each of which pulls the other end of the first supporting frame in the lateral direction.

14. The ink jet recording apparatus according to claim 1, wherein the first and second supporting frames of the supporting frame are connected to each other by a connecting member.

15. The ink jet recording apparatus according to claim 1, wherein the bending correction unit comprise springs, and apply pressing forces or tensile forces, which are generated by the springs, to the first supporting frames.

16. The ink jet recording apparatus according to claim 15, wherein the bending correction unit further comprise levers, and apply pressing forces or tensile forces, which are generated by the springs, to the first supporting frames through the levers.

17. The ink jet recording apparatus according to claim 1, wherein the bending correction unit comprise first springs each of which pulls one end of the first supporting frame in a lateral direction and second springs each of which pulls the other end of the first supporting frame in the lateral direction.

18. The ink jet recording apparatus according to claim 1, wherein the bending correction unit apply tensile forces to the first supporting frames of the supporting frames that are adjacently disposed.

19. The ink jet recording apparatus according to claim 1, wherein the first and second supporting frames of the supporting frames are arranged in series in an ink jetting direction of the ink jet head supported by the first supporting frame.

20. The ink jet recording apparatus according to claim 1, further comprising:

a carriage on which the mount is mounted.

* * * * *